US009657423B2

(12) United States Patent
Daniels et al.

(10) Patent No.: US 9,657,423 B2
(45) Date of Patent: May 23, 2017

(54) SYSTEM FOR CONTROLLING SUPPLY OF OZONE TO WASHING MACHINE TO MAXIMIZE CUMULATIVE CT VALUE

(71) Applicant: AWOIS LLC, Auburn, NH (US)

(72) Inventors: Ralph G. Daniels, Derry, NH (US); David A. Spofford, Northwood, NH (US)

(73) Assignee: AWOIS LLC, Auburn, NH (US)

( * ) Notice: Subject to any disclaimer, the term of this patent is extended or adjusted under 35 U.S.C. 154(b) by 655 days.

(21) Appl. No.: 13/949,691

(22) Filed: Jul. 24, 2013

(65) Prior Publication Data

US 2014/0033445 A1 Feb. 6, 2014

Related U.S. Application Data

(63) Continuation-in-part of application No. PCT/US2012/049179, filed on Aug. 1, 2012, and a (Continued)

(51) Int. Cl.
*D06F 33/02* (2006.01)
*D06F 35/00* (2006.01)

(52) U.S. Cl.
CPC ..... *D06F 33/02* (2013.01); *D06F 35/001* (2013.01); *D06F 2202/10* (2013.01); *D06F 2204/02* (2013.01); *D06F 2204/086* (2013.01)

(58) Field of Classification Search
CPC ..... D06F 35/001; D06F 33/02; A61L 12/183; A61L 2202/26
See application file for complete search history.

(56) References Cited

U.S. PATENT DOCUMENTS 5,313,811 A * 5/1994 Wasinger ..... D06F 35/001 68/13 R
5,493,743 A 2/1996 Schneider et al.
(Continued)

FOREIGN PATENT DOCUMENTS

| | | | |
|---|---|---|---|
| DE | 10 2010 029 885 | A1 | 12/2011 |
| GB | 1307691 | | 2/1973 |
| WO | 2008/051746 | A2 | 5/2008 |
| WO | 2011/161069 | A2 | 12/2011 |

OTHER PUBLICATIONS

Supplementary European Search Report filed in corresponding EPO application EP 12 86 6544 dated Aug. 18, 2015.
(Continued)

*Primary Examiner* — David Cormier
(74) *Attorney, Agent, or Firm* — Davis & Bujold PLLC; Michael J. Bujold

(57) ABSTRACT

Method and system for controlling a concentration of ozone is a washing machine to be at or below a target value so that a cumulative contact time of the ozone with laundry approaches a duration of time of an entire wash stage or cycle thereby ensuring killing of any infectious diseases. The method comprises supplying ozone to the washing machine, upon filling the washing machine, and supplementing the supplied ozonated water by supplying additional ozone to the wash machine during each wash stage or cycle, and controlling the supply of ozone supplied to the wash machine so that the concentration of ozone sampled or exhausting from the washing machine is controlled to be within a control band between 60% and 100% of the target value and the cumulative contact time of the ozone with the laundry is at least 60% of the duration of the entire wash stage or cycle.

18 Claims, 14 Drawing Sheets

Related U.S. Application Data continuation-in-part of application No. PCT/US2012/022212, filed on Jan. 23, 2012.

(60) Provisional application No. 61/435,555, filed on Jan. 24, 2011.

(56) References Cited

U.S. PATENT DOCUMENTS

| | | | | |
|---|---|---|---|---|
| 5,960,649 | A * | 10/1999 | Burdick | D06F 35/001 68/12.12 |
| 2002/0032931 | A1* | 3/2002 | Teran | D06F 35/001 8/158 |
| 2008/0092610 | A1 | 4/2008 | Kuo et al. | |
| 2008/0302139 | A1 | 12/2008 | Zorn | |
| 2009/0072883 | A1* | 3/2009 | Ehrlich | D06F 39/005 327/517 |
| 2010/0107343 | A1 | 5/2010 | Daniels et al. | |
| 2010/0196194 | A1* | 8/2010 | Voeten | A61L 2/24 422/3 |
| 2010/0313610 | A1 | 12/2010 | Smith et al. | |

OTHER PUBLICATIONS

International Search Report corresponding to PCT/US2012/022212 mailed on Sep. 3, 2012.
International Search Report corresponding to PCT/US2012/049179 mailed on Nov. 15, 2012.

* cited by examiner

| TIME | HYBRED | DIFFUSION | VENTURI | STEP |
|---|---|---|---|---|
| 0 | 0 | 0 | 0 | |
| 1 | 1 | 0.1 | 1.4 | WASH |
| 2 | 0.5 | 0.2 | 0.2 | WASH |
| 3 | 0.6 | 0.3 | 0 | WASH |
| 4 | 0.6 | 0.4 | 0 | WASH |
| 5 | 0.7 | 0.4 | 0 | WASH |
| 6 | 0.8 | 0.5 | 0 | WASH |
| 7 | 0.9 | 0.6 | 0 | WASH |
| 8 | 1.1 | 0.6 | 0 | WASH |
| 9 | 0.5 | 0.3 | 0 | |
| 10 | 0.9 | 0.4 | 0.7 | |
| 11 | 0.8 | 0.5 | 0.3 | WASH |
| 12 | 0.85 | 0.5 | 0 | WASH |
| 13 | 0.9 | 0.5 | 0 | WASH |
| 14 | 1 | 0.5 | 0 | WASH |
| 15 | 0.8 | 0.6 | 0 | WASH |
| 16 | 1.1 | 0.6 | 0 | WASH |
| 17 | 0.8 | 0.3 | 0 | |
| 18 | 0.85 | 0.4 | 0.7 | |
| 19 | 0.95 | 0.5 | 0.4 | RINSE |
| 20 | 1 | 0.6 | 0 | RINSE |
| 21 | 0.7 | 0.4 | 0 | DRAIN |
| 22 | 1.2 | 0.5 | 0.7 | FILL |
| 23 | 1 | 0.7 | 0.5 | RINSE |
| 24 | 1.1 | 0.9 | 0.3 | RINSE |
| 21 | 0.7 | 0.4 | 0 | DRAIN |
| 25 | 0.7 | 0.5 | 0 | FILL |
| 26 | 1.2 | 0.6 | 0.8 | SOUR |
| 27 | 0.9 | 0.8 | 0.6 | SOUR |
| 28 | 0.95 | 0.9 | 0.5 | SOUR |
| 21 | 0.7 | 0.4 | 0.01 | DRAIN |
| 31 | 0.5 | 0.3 | 0.01 | |
| 32 | 0.4 | 0.2 | 0.01 | |
| 32 | 0.3 | 0.1 | 0.01 | |
| 34 | 0.1 | 0.05 | 0.01 | |
| 32 | 0.01 | 0.01 | 0.01 | |
| TOTAL | 27.11 | 15.56 | 7.15 | |

FIG.7

SYSTEM FOR CONTROLLING SUPPLY OF OZONE TO WASHING MACHINE TO MAXIMIZE CUMULATIVE CT VALUE

This application claims priority from international patent application serial no. PCT/US2012/049179 filed Aug. 1, 2012 and is a continuation-in-part of international patent application serial number PCT/US2012/22212 filed on Jan. 23, 2012, which claims priority from U.S. provisional application Ser. No. 61/435,555 filed on Jan. 24, 2011 and from.

FIELD OF THE INVENTION

The present invention relates to a method and a system for accurately measuring the quantity of ozone contained within each washing machine in order to more precise control the supply of ozonated water to the washing machine and thereby maximize the use of ozone in order to thoroughly and completely clean, sanitize and/or disinfect the laundry being washed in the shortest time possible.

BACKGROUND OF THE INVENTION

The use of ozone in cleaning and sanitizing laundry has been utilized for quite some time. The primary reason is that ozone is generally recognized as being effective in cleaning as well as deodorizing and sanitizing laundry while also minimizing impact to the environment. With respect to commercial applications, however, ozone is generally the preferred cleaning component as it is relatively inexpensive to manufacture and quite reliable in deodorizing and sanitizing laundry.

As is well known, the application of ozone to a cleaning fluid, such as water, acts as a disinfectant as well as assists with removing dirt, debris and other contaminants from the laundry detergent so that the laundry detergent can again be effective in removing additional dirt, debris and other contaminants from the clothing or other laundry being laundered. While it is known that dissolving ozone in a liquid, such as water, will assist with improving the cleaning and sterilization efficiency of the liquid, a number of the currently available prior art systems suffer a variety of associated drawbacks. In particular, a portion of the ozone which is added to the liquid does not become completely dissolved within the water so that such ozone can not readily directly contact any substance(s) dissolved or contained within the wash water. As a result, the undissolved ozone is rapidly given off, dissipated and/or evaporated from the liquid (wash water) as soon as the liquid enters into a reservoir, e.g., contact chamber, or some other expansion chamber, for example. As a result, such undissolved ozone is not effective in cleaning and/or disinfecting the laundry and thus not all of the ozone, which is added to the liquid or water, is active or effective in achieving the desired cleaning and/or sterilization of the laundry intended by the ozonated liquid. Further, many times, some of the replacement liquid or wash water, which is added to the washing machine during one or more of the wash cycles or stages, does not contain any ozone and such unozonated liquid generally increases the duration of the cleaning, sanitization and/or disinfection time for the laundry being washed.

It is to appreciated that washing laundry can be a relatively expensive process. It utilizes costly resources—water, energy, detergents and labor—and such laundering is often required not only to clean but completely disinfect and sanitize the laundry items. While conventional detergents and soap can be effective in removing dirt, grease, grime and other contaminants, they are not always effective in killing all of the germs and bacteria contained within the laundry. It is known to enhance the disinfection capabilities of a washing machine by introducing ozone into the washing water. The ozone improves cleaning of laundry, even at relatively low or cold wash water temperatures, and also has an antibacterial effect.

Previous systems for introducing ozone have included a simple bubble system in which ozone is bubbled through water in a washing machine drum. The efficiency of dissolving ozone in the water of such apparatus is somewhat low, and the concentration of dissolved ozone in the water is consequently low thereby resulting in only a minor enhancement in the cleaning and the antibacterial effect of the ozone. There is also the disadvantage that the amount of off-gas, i.e., the ozone which is readily given off and dissipated into the surrounding environment, from the wash water both during filling and/or during operation of the washing machine, can be considerable. The ozone gas will typically collect in the area surrounding one or more sampling ports, exhaust vents or some other outlet of the washing machine and can potentially cause health and/or safety problems in the event that any person, located adjacent or within the room accommodating the washing machine(s), is exposed to a high concentration of ozone.

In order to improve the efficiency with which ozone is dissolved in the wash water, systems using venturis have been developed. Such systems attempt to forcibly dissolve ozone in the water and thereby increase the concentration of dissolved ozone within the liquid or wash water (see the results of such a system depicted by FIG. 1) as a fresh water is added to the washing machine. However, the ozone is generally not completely and thoroughly mixed and dissolved within the water, so as to maximize contact of the dissolved ozone during the washing process and such ozone tends to dissolve out of solution fairly rapidly and become gaseous shortly after being mixed with the water and supplied to the washing machine. The contact time (CT) value for systems, which incorporate a direct injection of ozone into the water, tend to be fairly low, e.g., only achieve a CT value of 0.6 or less, for example.

In an attempt to improve the amount of ozone dissolved within the water, Daniels Equipment Company developed and manufactures a diffusion system in which the ozone is directly injected into the water contained, typically within a sump of the washing machine during the wash cycle or wash stage. The results of such system are depicted in FIG. 2 attached hereto. The CT value for such direct injection systems, which directly inject ozone into the water contained within the sump, tend to be much higher, e.g., achieved a CT value of 10.0, for example, during 20 minute wash. However, as noted in the following table, such CT values are still insufficient to kill some commonly known and prevalent infectious diseases.

With respect to commercial applications, during a typical wash cycle or wash stage, a number of infectious diseases must be reliably and consistently killed in order to prevent the spread of such infectious diseases. That is, in order to ensure reliable and consistent killing of desired infectious diseases, a cumulative contact time (CT) value—i.e., standard value calculated from the concentration of the disinfectant (i.e., parts per million or ppm of the ozone) multiplied by the total time or total duration (i.e., total minutes of wash cycle) that the disinfectant (i.e., the ozone) is in contact with the infectious disease(s)—must be achieved from the beginning of the wash cycle or wash stage and the end of the final wash cycle or wash stage. It must be appreciated from the above that the CT value can vary depending on the concentration level of the ozone as well as the time that the laundry has the ability to come into contact with any dissolved ozone (or possibly undissolved ozone). Correspondingly, in the event that the necessary cumulative CT value is not achieved by the end of the final wash cycle or wash stage, the operator can not be ensured that any infectious disease(s), which may be contained within the washed laundry, is effective cleaned and/or sanitized. Table 1 below sets forth an example of common accepted CT values for various infectious diseases.

TABLE 1

| Microbe (Bacteria or Virus) | CT Value for Disinfection | Percent Reduction | Log Reduction |
|---|---|---|---|
| *Salmonella Choleraesuis* | 6 | 99.9999% | 6 log |
| *Staphylococcus Aureus* (MRSA) | 20 | 99.9999% | 6 log |
| *Pseudomonas Aeruginosa* | 10 | 99.9999% | 6 log |
| *Trichophyton Mentagrophytes* | 1 | 99.9999% | 6 log |
| *Listeria Monocytogenes* | 6 | 99.99% | 4 log |
| *Campylobacter Jejuni* | 6 | 99.99% | 4 log |
| *Aspergillus Flavus* | 10 | 99.99% | 4 log |
| *Brettanomyces Bruxellenis* | 6 | 99.99% | 4 log |
| *Escherichia Coli* | 1 | 99.999% | 5 log |
| *Clostridium Difficile* (*C. Diff*) | 4 | 99.999% | 5 log |
| Viruses | 3 | 99.999% | 5 log |
| *Giardia* | 2 | 99.99% | 4 log |

SUMMARY OF THE INVENTION

It is an object of the present invention is to substantially completely dissolve and/or encapsulate a maximum amount of ozone within the water, used in a washing machine, during the filling phase and/or during each subsequent filling cycle or wash stage. In addition, the present invention is directed at adding additional ozone to the water, contained within the wash machine during each wash cycle or wash stage, so as to maintain the amount of dissolved and/or encapsulated ozone at as high a level as possible, i.e., at a target level, without creating a safety risk and also accurately measure the added ozone so as to facilitate closer monitoring and control of the ozone added to the washing machine. That is, the present invention is directed at improved control of a maximize amount of ozone which is dissolved and/or encapsulated in water and also directed at maintaining the ozone dissolved and/or encapsulated within liquid for as long a time period as possible so that such dissolved and/or encapsulated ozone can intimately contact the laundry and facilitate cleaning, sterilization and/or sanitation thereof as thereby increase the CT value.

A further object of the invention is to fill the washing machine either with fresh water of only ozonated water, so as to immediately immerse the laundry within ozonated water, and thereby increase the contact time of the ozonated water with the laundry and facilitate a more complete and thorough cleaning, sterilization and/or sanitation of the laundry during a each conventional wash cycle or wash stage as well as the entire laundry wash cycle.

A still further object of the present invention is to maintain the laundry in intimate contact with the ozonated water for as long a duration of time as possible so that laundry is completely and thorough cleaned, sterilized and/or sanitized, during the wash cycle or wash stage, and thereby reducing the required wash duration of time for a complete and total cleaning, sanitizing and/or sterilizing the washed laundry.

Yet another object of the present invention is to increase the CT value, achieved by the ozone, so as to kill the widest array of infectious diseases over the shortest possible time span at CT values which have not been previously achieved by any prior art washing machines or systems, including a tunnel or a continuous batch washer thereby further improving the cleaning, sanitization and/or disinfection of the washed laundry at the completion of the final wash cycle or wash stage so as to prevent the spread of any infectious disease(s).

Another object of the present invention is to position a static mixer, immediately following injection of the ozone into the filling water, to assist with a thorough and complete mixing and dissolving the ozone within the filling water, prior to the filling water being discharged into the internal drum of the washing machine for washing. Preferably the ozonated water, upon exiting the static mixer, experiences a hold or dwell time of about three seconds or so prior to such ozonated and pressurized filling water being discharged into the washing machine to further assist with dissolving the ozone within the pressurized filling water. As soon as the ozonated filling water enters the washing machine, the pressurized filling water returns back to atmospheric pressure. A dwell time of about three seconds, plus or minus one second, further improves and/or increases the amount of ozone which is dissolved and/or encapsulated within the ozonated water and thereby increases the amount of dissolved ozone within the water so that the ozone concentration level of the filling water approaches about 90%. This greater amount of ozone, which is initially dissolved and/or encapsulated within the filling water, in turn, facilitates a more through cleaning as well as deodorization and/or sanitization of the laundry, during the wash cycle or wash stage, and also minimizes the amount of ozone which gasses off and exhausts from the washing machine during any wash cycle or wash stage. In addition, by having a greater amount of ozone dissolved and/or encapsulated within the ozonated water, such greater concentration of dissolved and/or encapsulated ozone further increases the CT value of the ozone with the laundry and this results in a more through cleaning, deodorization and/or sanitization of the laundry being washed.

It is another object of the present invention to provide a system in which the amount of ozone generated, during each wash cycle or wash stage, is controlled so that an optimum amount of ozone is generated, supplied to and dissolved and/or encapsulated within the wash water, during each one of the separate wash cycles or wash stages, so that the laundry is constantly subjected to the greater permissible concentration ozone and thereby is efficiently and consistently cleaned over the shortest possible duration of time.

Yet another object of the present invention is to ensure that a sufficient amount of ozone is present during the initial wash cycle or wash stage, where the ozone can be readily used to commence "burning off" the dirt, grease, grime and other contaminants as well as commence killing of "super bugs", germs and bacteria (i.e., it is to be appreciated that ozone is effective in killing 99.99% of the super bugs, germs and bacteria contained within the laundry when a sufficient CT is achieved), while the system still has the ability to control, modify, vary, interrupt or reduce the amount of ozone generated during each later or subsequent wash cycle or wash stage when less ozone is typically required.

Still another object of the present invention is to provide the system with a sensor which will completely shut off production of ozone, or possible sufficiently reduce the production of ozone, in the event that the ozone being sampled, exiting or exhausted from the washing machine indicates that excess ozone, above the target value, is exiting, being sampled or exhausted from the washing machine, e.g., the system indicates an ozone level exhausting from the washing machine is greater than a target value of generally about 1.0 (ppm) parts per million or higher, for example. It is to be appreciated that the target value can be readily adjusted to any other generally accepted higher or lower standard or to suit any particular application.

A still further object of the present invention is to attempt to maintain the dissolved and/or encapsulated concentration of ozone within the water as close as possible to the selected target value so that the laundry is provided with the maximum opportunity to be constantly and consistently in intimate contact with the wash water which has the greatest possible amount of ozone dissolved and/or encapsulated therein. That is, preferably the present invention controls the amount of ozone so as to have an average ozone value which is generally between 50% and 100% of the ozone target value, more preferably the present invention controls the amount of ozone to have an average dissolved and/or encapsulated ozone value which is generally between 60% and 100% of the ozone target value, and most preferably the present invention controls the amount of ozone to have an average dissolved ozone value which is generally between 70% and 100% of the ozone target value.

Another object of the present invention is to provide the system with a fail safe sensor which will completely shut down the production of ozone, or sufficiently reduce production of ozone, in the event that the ozone level, in the room or an area accommodating the washing machine(s), increases above a level which creates a potentially hazardous situation for the health and/or safety of human beings, e.g., the ozone level in a room reaches the ozone target value of 0.1 (ppm) parts per million of ozone, for example.

A further object of the invention is to provide a system for detecting and displaying the current CT value during the entire wash cycle or wash stage of the washing machine and to record and/or display this information to the operator. The CT value detection system includes an ozone exhaust or sampling sensor detector, typically located at an exhaust outlet or sampling port of the washing machine (or at any other desired location which can sense, monitor or detect the concentration of the ozone in washing machine) which periodically senses, measures or detects the concentration of the ozone being sampled or exhausted from the washing machine, e.g., once every 1 second, 5 seconds, 10 seconds, 30 seconds, 1 min., etc.

Yet another object of the present invention is to place the ozone sampling sensor or detector directly within the contact chamber of the washing machine, i.e., typically between the rotating drum and the sealed exterior housing of the washing machine or at any other desired location where the ozone sampling sensor or detector can directly sense, monitor and/or detect the concentration of the ozone currently contained within washing machine, so that the ozone sampling sensor or detector can obtain a substantially undiluted sample of the ozone, contained within the wash machine, and thereby more precisely detect the amount of ozone contained therein. The detected ozone sample, once measured by the ozone sampling sensor or detector, can then either be returned back to the contact chamber to facilitate further contact with the laundry or converted into oxygen and vented to the atmosphere.

Still another object of the invention is to facilitate collection of a substantially undiluted sample of gas from the sealed contact chamber, i.e., the rotating wash from, contained within the sealed washer machine, so as to provide a more accurate detection of the amount of ozone actually contained within the washing machine and thereby provide a more precise and accurate control of the amount of ozone being supplied to the washing machine. This, in turn, results in a more accurate detection and displaying the current CT value during the entire wash cycle or wash stage of the washing machine as well is more accurate recordation and/or display of this detected information to the operator. The CT value detection system includes an ozone sampling sensor or detector directly which is located within the contact chamber, i.e., typically between the rotating drum and the sealed exterior housing of the washing machine—or at any other desired location which can directly sense, monitor and/or detect the concentration of the ozone currently contained within washing machine). The method and system are also directed at continuously sensing, measuring and/or detecting the concentration of the ozone contained within and capable of being exhausted from the washing machine. The CT value detection system will continuously compute the detected cumulative CT value (typically in parts per million), as the wash progresses from the beginning of the first wash cycle or wash stage until completion of the last wash cycle or wash stage, and generally indicates either the actually calculated cumulative CT value, via a numeric display, or merely activates a green light, which indicates that a sufficient cumulative CT value has been achieved during the wash (e.g., a cumulative CT value of 21, for example), while a red light, which indicates that an insufficient cumulative CT value is achieved, is activated at the beginning of the first wash cycle or wash stage and remains activated until a sufficient cumulative CT value has been achieved during the wash. Preferably, a room detector is also provided for recording and/or displaying the amount of ozone which is detected within the room, accommodating a single or a plurality of washing machines, so that this information can be later retrieved for possible fine tuning of the control of the ozone system.

A still further object of the present invention is to inject the produced ozone, having a particle size of about 2 microns to 20 microns, and more preferably having a particle size of from about 5 to 10 microns, directly into either the sump of the washing machine, typically located beneath the washing machine, or directly into the water contained within the washing machine along with injecting ozone directly into the fresh water which initially fills the internal drum of the washer machine with ozonated water. By supplying ozonated water initially to the washing machine, the concentration of the ozone, contained therein, is as close as possible to the target ozone value or level immediately at the beginning of the wash cycle or wash stage. In addition, by injecting ozonated water into water during continued operation of the washer machine, the ozone content remains as close as possible to the target ozone value or level during the entire wash, i.e., from the first wash cycle or wash stage to the last wash cycle or wash stage.

Another object of the invention is to provide a method and a system in which a cumulative contact time (the cumulative CT value) approaches the duration of time of the entire wash cycle or wash stage. That is, the total value of the cumulative contact time (the cumulative CT value in ppm*minute) approaches or is at least 60% of the total duration of the entire wash cycle or wash stage (minutes multiplied by 1 ppm). Accordingly, if the total duration of the entire wash cycle or wash stage is 35 minutes, the cumulative contact ozone time (the cumulative CT value) is at least 21

(ppm*minute) which is 60% of the 35 minute total duration of the entire wash cycle or wash stage multiplied by 1 ppm (i.e., 35 minutes*1 ppm*0.60=21 ppm*minute). More preferably the cumulative contact ozone time (the cumulative CT value) is at least 70% or 80% of the total duration of the entire wash cycle or wash stage, e.g., at least 24.5 (ppm*minute) which is 70% of the 35 minute total duration of the entire wash cycle or wash stage multiplied by 1 ppm (i.e., 35 minutes*1 ppm*0.70=24.5 ppm*minute).

The present invention relates to a method of controlling a concentration of ozone of a washing machine to be at or below a target value so that a cumulative contact time of the ozone with laundry being washed approaches a duration of time of an entire wash cycle of the washing machine thereby ensuring killing of infectious diseases contained within the laundry, the method comprising the steps of: supplying ozonated water the wash machine; withdrawing an ozone sample from an internal cavity of the washing machine in order to detect a concentration of the ozone within the washing machine; and controlling the supply of ozone to the wash machine so that the concentration of ozone of the washing machine being controlled to be within a band which between 60% and 100% of the target value and the cumulative contact time of the ozone with the laundry is at least 60% of the duration of time of the entire wash cycle.

The present invention also relates to a system for controlling a concentration of ozone in a washing machine to be at or below a target value so that a cumulative contact time, of the ozone with laundry being washed by the washing machine, approaches a duration of time of an entire wash cycle of the washing machine thereby ensuring killing of any infectious diseases contained within the laundry, the system comprising: a washing machine having a rotatable drum for containing laundry and a quantity of a water; an ozone generator, connected to the washing machine, for supplying ozone to the washing machine, upon initially filling the washing machine and during at least one other wash cycle; an ozone sampling sensor or detector for directly sensing a concentration of ozone in the washing machine during operation thereof, and the ozone sampling sensor or detector being coupled for modifying production of ozone, by the ozone generator, when the sensed concentration of ozone, withdrawn from the washing machine by the ozone sampling sensor or detector, exceeds a target level such that the supply of ozone to the washing machine is controlled so that the concentration of ozone is within a band between 60% and 100% of the target value and the cumulative contact time of the ozone with the laundry is at least 60% of the duration of time of the entire wash.

The present invention further relates to a method of controlling a concentration of ozone of a washing machine to be at or below a target value so that a cumulative contact time of the ozone with laundry being washed approaches a duration of time of an entire wash cycle of the washing machine thereby ensuring killing of infectious diseases contained within the laundry, the method comprising the steps of: supplying ozonated water the wash machine; withdrawing an ozone sample from an internal cavity of the washing machine in order to detect a concentration of the ozone within the washing machine; and controlling the supply of ozone to the wash machine so that the concentration of ozone of the washing machine being controlled to be within a band which between 60% and 100% of the target value and the cumulative contact time of the ozone with the laundry is at least 60% of the duration of time of the entire wash.

The present invention finally relates to a system for controlling a concentration of ozone in a washing machine to be at or below a target value so that a cumulative contact time, of the ozone with laundry being washed by the washing machine, approaches a duration of time of an entire wash cycle of the washing machine thereby ensuring killing of any infectious diseases contained within the laundry, the system comprising: a washing machine having a rotatable drum for containing laundry and a quantity of a water; an ozone generator, connected to the washing machine, for supplying ozone to the washing machine, upon initially filling the washing machine and during at least one other wash cycle; an ozone sampling sensor or detector for directly sensing a concentration of ozone in the washing machine during operation thereof, and the ozone sampling sensor or detector being coupled for modifying production of ozone, by the ozone generator, when the sensed concentration of ozone, withdrawn from the washing machine by the ozone sampling sensor or detector, exceeds a target level such that the supply of ozone to the washing machine is controlled so that the concentration of ozone is within a band between 60% and 100% of the target value and the cumulative contact time of the ozone with the laundry is at least 60% of the duration of time of the entire wash cycle.

It is to be appreciated that when amount of sampled ozone exceeds the target value, this signifies that there is excess ozone within the water and exiting from the washing machine. Since there is excess ozone within the water, this excess ozone is quickly and rapidly converted into gaseous form which exhausts from a washing machine and can quickly result in a hazardous situation. Accordingly, it is desirable to stop immediately further production of ozone as soon as the method and the system detects the concentration of ozone, contained within the washing machine, is exceeding the target value.

As used within the specification and the appended claims, the term "entire wash cycle" means the duration of time from the instance that the washing machine is initially started, or laundry enters the washing machine until the time that the door of the washing machine is open to provide access and remove or, in the case of a tunnel or a continuous batch washer, the duration of time from the instance that the laundry is feed into the continuous washing machine until the time that the laundry exits the continuous washing machine.

As used within the specification and the appended claims, the term "average dissolved ozone value" means the average value of the ozone which is dissolved and/or encapsulated within the water during the entire wash cycle, i.e., commencing from the beginning of the wash cycle until completion of all of the wash cycle and the door is opened to access and remove the laundry.

As used within the specification and the appended claims, the term "modifies production of ozone" means that the production of ozone can be modified, reduced or altered so as to be somewhat lower than the current production level of ozone or can be totally or completely discontinued so that no further ozone is being produced, or a production amount of ozone can be anywhere in between zero and 100% of the ozone target value.

As used within the specification and the appended claims, the term "washing machine" means both front and top loading conventional washing machines as well as a tunnel or a continuous batch washer.

BRIEF DESCRIPTION OF THE DRAWINGS

Preferred embodiments of the present invention will now be described, by way of example only and not in any limitative sense, with reference to the appended drawings in which:

FIG. 7 is a table of date data showing a comparison of the gaseous ozone content, achieved by the present invention, in comparison to two prior art ozone systems;

DETAIL DESCRIPTION OF THE DRAWINGS

Figure 3:
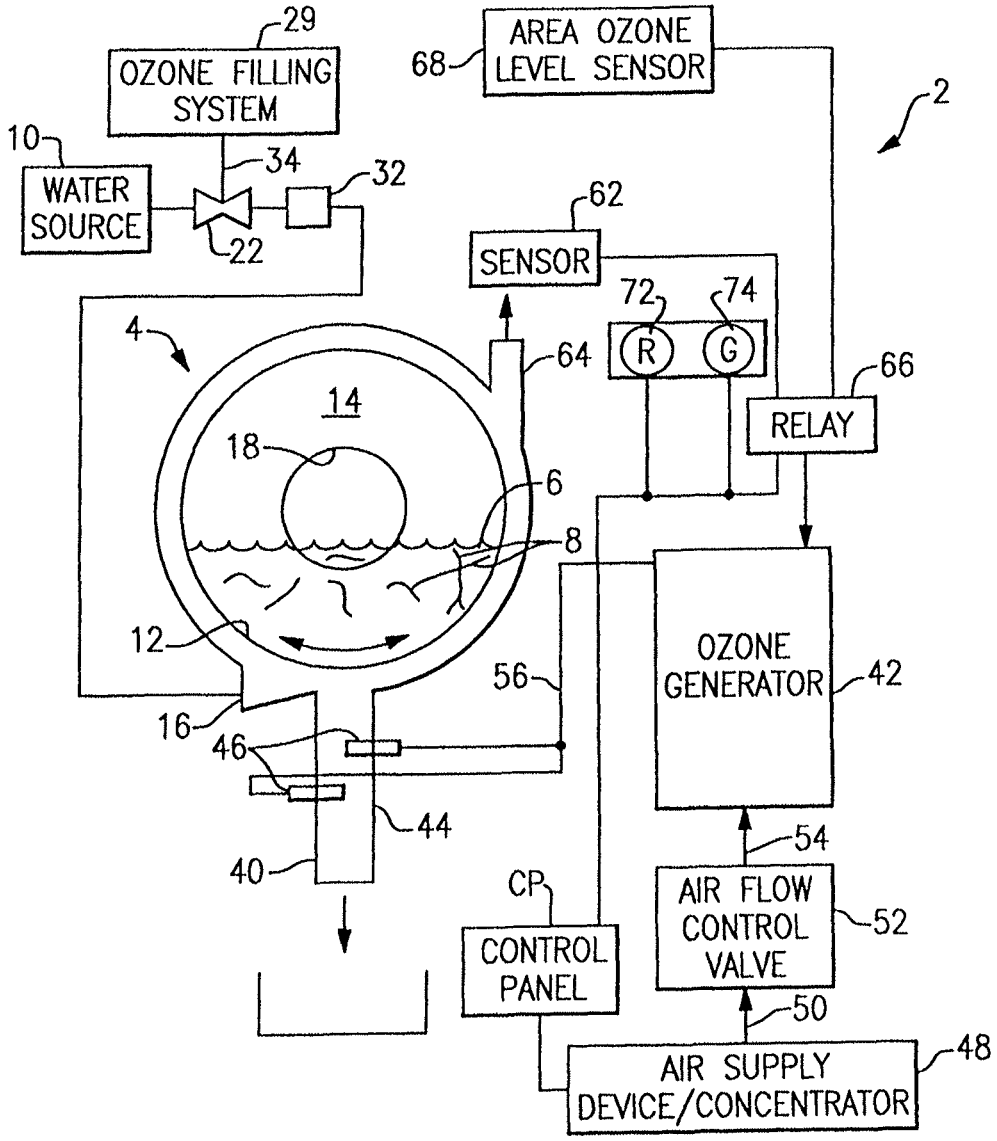
FIG. 3 shows the improved system, according to an embodiment of the present invention, for controlling a supply of ozone to a washing machine both during the filling phase as well as during each subsequent wash cycle(s)
Figure 3A:
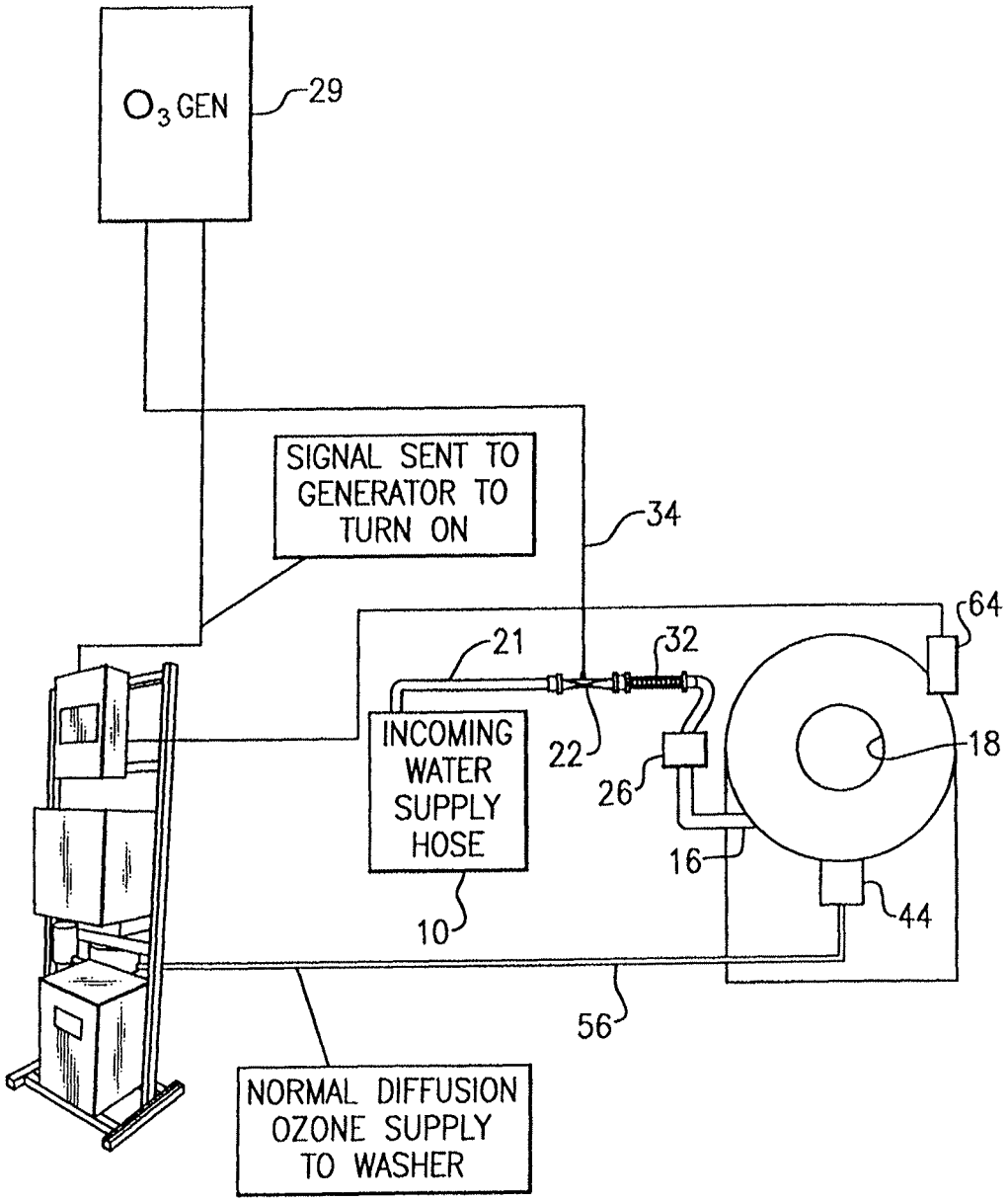
FIG. 3A shows a commercial embodiment of the improved system of FIG. 3.
Figure 4:
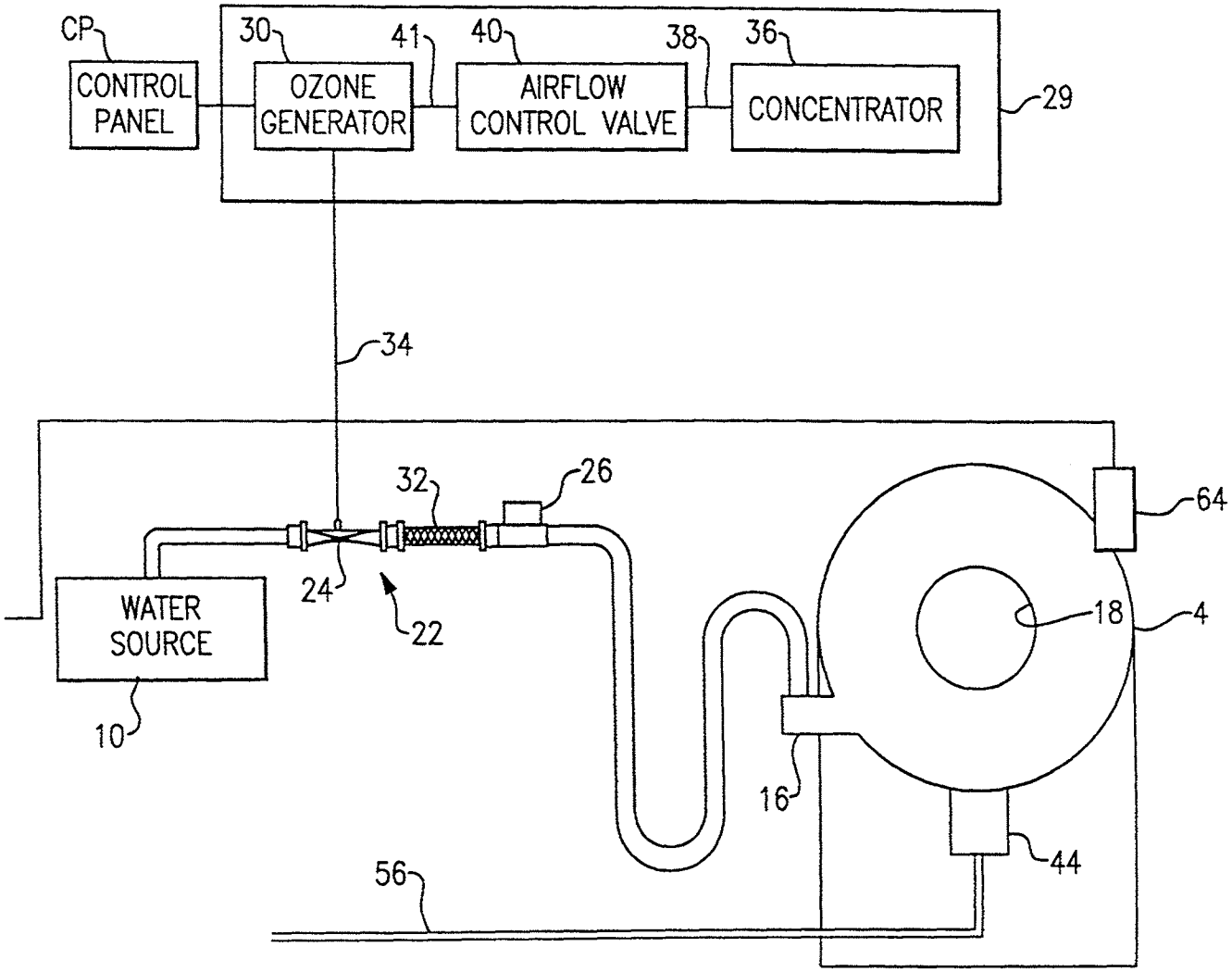
FIG. 4 is an enlarged diagrammatic drawing showing the venturi and the static mixed components for intermittently mixing the fresh water with the ozone to provide a substantially uniform mixture thereof which assists with retaining the ozone within the water for a longer duration of time once the ozonated water is supplied to the washing machine.

With reference now to FIGS. 3, 3A and 4, a detailed description concerning the present invention will now be discussed in detail.

According to this embodiment, as is conventional in the art, the ozone system 2 generally comprises a washing machine 4 which, during use, is filled with a suitable volume of liquid or wash water 6, i.e., a washing volume of water, to facilitate washing of the laundry 8 contained within the washing machine 4. The water is typically supplied from a water supply source 10 to a rotatable internal drum 12, located within an internal chamber 14 of the washing machine 4, via a fresh water supply inlet 16. As is conventional in the art, the washing machine 4 is provide with a hinged door 18, typically located on either the front or the top of the washing machine 4 that generally forms a water tight seal with the door opening of the washing machine 4, in a conventional manner, when the door 18 is latched in a closed position (in FIG. 3 the door is shown in the front of the washing machine 4). The door 18, when in its opened position, facilitates adding and removing laundry 8 from the washing machine 4. As such door and its associated latching mechanism are conventional and well known in the art, a further detailed discussion concerning the same is not provided.

During the initial as well as any subsequent filling cycle, when washing laundry 8, the filling water flows from the water supply source 10, along a filling water conduit 21, into an inlet of a venturi 22, such as a venturi manufactured in accordance with U.S. Pat. No. 5,863,128. As the water passes through the venturi 22, the water is accelerated, via the centrally located constriction 24 of the venturi 22 (see FIG. 4), and such acceleration of the water induces a vacuum in an ozone supply line 34 that is coupled to the venturi 22 so as to draw in ozone which is supplied from an ozone supply, generally indicated as 29, to the venturi inlet 28 of the venturi 22. Typically the supply pressure of the fresh water flowing through the venturi 22 is between about 40 PSI and about 80 PSI. Both the ozone and the water, as those components exit the centrally located constriction 24, are decelerated and this induces intimate mixing of those two components with one another. In order to achieve a more complete and thorough mixing as well as more complete dissolving and/or encapsulation of the ozone within the water, the water/ozone mixture then passes through a static mixer 32, such as a static mixer manufactured in accordance with U.S. Pat. No. 3,923,288 by Ozone Solution of Hull, Iowa. As the water/ozone mixture passes through the static mixer 32, the static mixer 32 causes the ozone to be intermittently mixed, dispersed and/or dissolved and/or encapsulated within and throughout the water. As a consequence, the static mixer 32 thereby facilitates a more complete and thorough dissolving of the ozone within the water and this generally facilitates a longer retention of the dissolved and/or encapsulated ozone within the water. As the ozone and water mixture exits the static mixer 32, preferably this mixture undergoes a dwell time of about 3 seconds, plus or minus one second. This dwell time further facilitates a more complete and thorough dissolving and/or encapsulation of the ozone within the water. In the event that there is sufficient room to provide a suitable dwell time prior to this ozone/water mixture exiting the fresh water supply inlet 16, a U-shaped (see FIG. 4), a helical shaped segment, or some other suitable segment of conduit or piping can be inserted along the supply line 21 of the ozonated water to facility the desired dwell time of the ozone/water mixture prior to the ozonated water entering and discharging into washing machine. A water supply valve 26, which controls the flow of filling water into the washing machine 4, is generally located downstream of the static mixer 32.

The ozone supply 29 includes a filling ozone generator 30 which is connected to the venturi inlet 28 of the venturi 22 via the ozone supply line 34 for supplying ozone thereto. Typically, the ozone generator 30 will constantly and continuously produce ozone during the entire operating cycle of the washing machine 4 and such produced ozone is normally retained within the ozone generator 30 and only withdrawn therefrom when necessary or required, e.g., as water flows through the venturi 22 and sucks or draws the ozone from the ozone generator 30. That is, as the water is flows through the venturi 22, the water induces a vacuum at the venturi inlet 28 of the venturi 22 and such vacuum, in turn, sucks or draws a desired quantity of the produced ozone, along the ozone supply line 34, from the ozone generator 30 into the water. The ozone generator 30 is electrically connected to the control panel CP, as described below in further detail, to facilitate both control and operation of all the ozone generators as well as facilitate interruption of the ozone when a hazardous condition arises.

Preferably, a conventional air supply device/oxygen concentrator 36 compresses room air to a pressure of about 5 pounds per square inch or so and supplies this pressurized room air, via a conventional supply duct or pipe 38, to an air flow control valve 40 which regulates the flow rate of the air being supplied to filling ozone generator 30. The air supply device/oxygen concentrator 36, during normal compression of the air, typically removes nitrogen from the air and thereby naturally increases the overall oxygen content of the air which, in turn, facilitates subsequent production of ozone. The air supply device/oxygen concentrator 36 also typically removes water, moisture and other impurities from the air prior to supplying the same to the filling air flow control valve 40.

The air flow control valve 40 is connected, via a conventional supply duct or pipe 41, to supply the pressurized and regulated air to an inlet of the filling ozone generator 30 where a portion of such air, e.g., typically about 5% of the supplied air, is converted into ozone in a conventional fashion. As such conversion of air into ozone is conventional and well known in the art, a further detailed discussion concerning the same is not provided. As noted above, the outlet of the filling ozone generator 30 is connected, via the supply duct or pipe 34, to the venturi inlet 28 for supplying the generated ozone, as necessary, thereto.

As long as the ozone/water mixture is being supplied along the supply line 21, this ozone/water mixture remains at the supply pressure of the filling water, and thus the ozone continues to mix intimately and dissolve and/or encapsulate within the water and thereby achieve a greater concentration of dissolved and/or encapsulated ozone within the water. The inventors have determined that the static mixer 32 generally enhances the dissolved and/or encapsulated rate of the ozone within the water by as much as an additional 20% or so. This increased amount of dissolved and/or encapsulated ozone within the water, in turn, facilitates longer contact time between the ozone and the laundry and thus a more thorough and complete cleaning, sterilization and/or sanitization of the laundry 8 being washed.

As will be described below in further detail, a commercial washer will typically include up to and including 8 separate wash stages or cycles, but it is to be appreciated the amount of wash stages or cycles can vary from washing machine to washing machine or application to application. During each one of the wash stages or cycles, a portion of the water contained within the internal drum 12 of the washing machine 4, e.g., typically between about 30% to about 70% of the water, is discarded or discharged from the washing machine 4 and replaced a quantity of fresh filling water to facilitate further washing of the laundry 8.

According to the present invention, each time fresh filling water to be supplied to the washing machine 4, such filling water may be either fresh water or "ozonated" water, as described above, prior to being supplied to the internal drum 12 of the washing machine 4 so that possibly only ozonated water is subsequently added to the washing machine 4 and utilized for washing the laundry 8. This assist with maintaining the laundry 8 within water which has a greater concentration of dissolved and/or encapsulated ozone therein. That is, the supplied ozone, for cleaning the laundry 8, is generally in an aqueous phase, i.e., dissolved and/or encapsulated within the water, and such aqueous phase ozone can immediately and instantaneously commence contact with the laundry 8 and facilitate cleaning, sterilization and/or sanitization of laundry 8 prior to and during each wash cycle. Moreover, by having a greater concentration of ozone dissolved and/or encapsulated within the water, this also minimizes the amount of ozone that rapidly gasses off from and out of the water and eventually exhausts from the washing machine 4 to possibly create a hazardous situation.

In order to further minimize the amount of ozone that rapidly gasses off from and out of the water, the ozone or ozonated water is preferably supplied to a lower most region of the internal drum 12 of the washing machine 4. By supplying the ozone and/or ozonated water in this manner, any ozone which has a tendency to be "gassed off," while being discharged into the internal drum 12, still must bubble and/or permeate through the water and the laundry contained within the washing machine 4 and thus still has a tendency to facilitate intimate contact with the laundry 8 thereby still achieving some cleaning, sterilization and/or sanitization of the laundry 8 prior to such gassed off ozone eventually exhausts from the washing machine 4 out through the exhaust vent 64, for example, as described below in further detail, or any other vent(s), port(s) or opening(s) in the washing machine.

Figure 5:
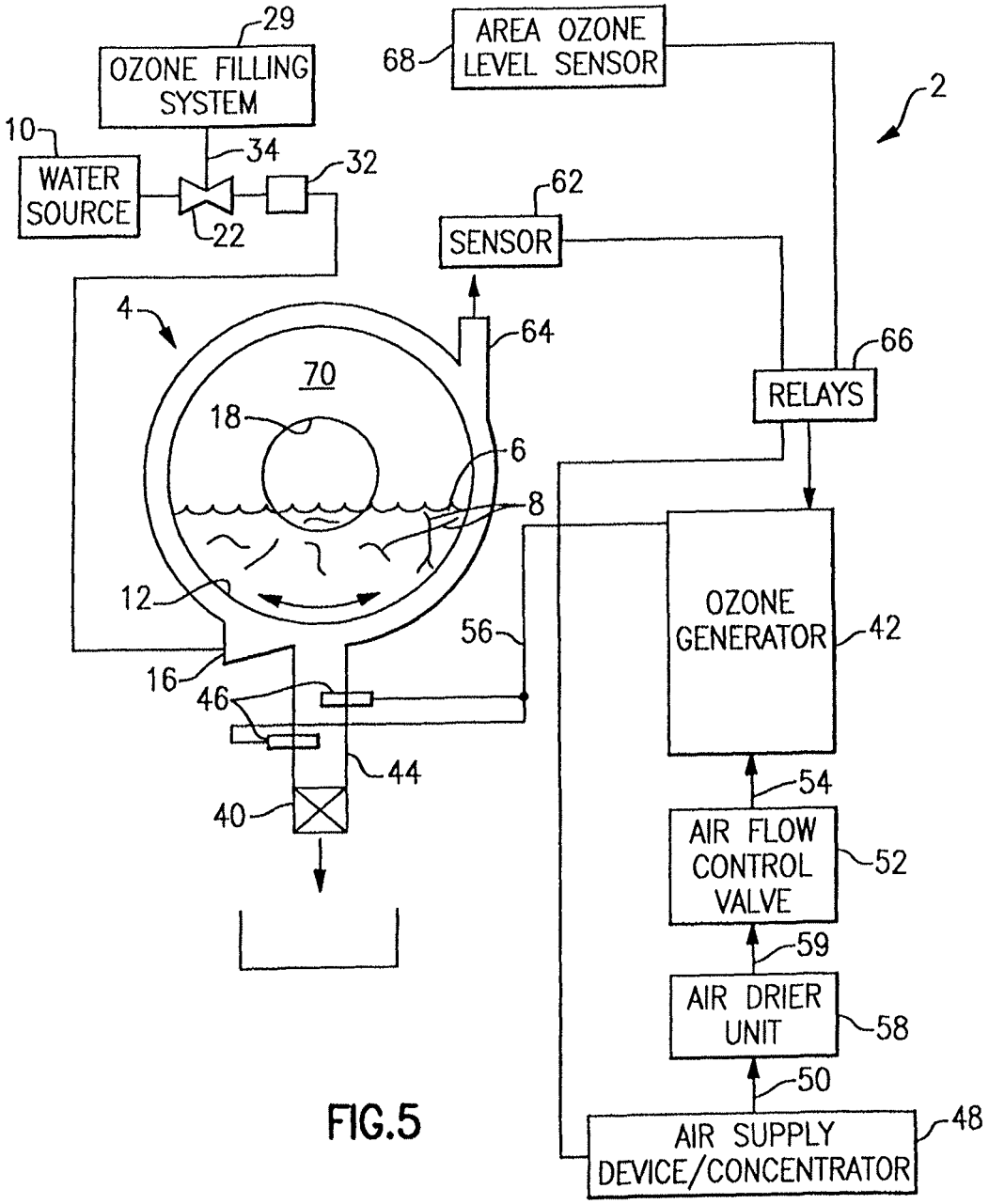
FIG. 5 shows a modification to the improved system of FIG. 3 having an air drier unit.

Prior to filling the washing machine 4 with filling water, a drain valve 40 is closed (see FIG. 5) to facilitate retention of the water 6 to be supplied to the internal chamber 14 of the internal drum 12 of the washing machine 4 from the water supply source 10. In addition, the washing machine 4 is generally equipped with an primary ozone generator 42 which commences production of ozone and injects the produced ozone into the sump 44 of the washing machine 4, via at least one and generally two or more (downwardly facing) spargers 46, where the ozone is discharged into the water 6. It is to be appreciated that not all washing machines have a sump and, in such instance, the ozone is merely injected into the water located within a lower most region of the washing machine. The water 6 and dissolved and/or encapsulated ozone are agitated, during normal operation of the washing machine 4, due to such to and fro agitating motion of the internal drum 12 to mix intimately and disperse the ozone, supplied via the spargers 46, throughout the entire volume of water 6 so that the ozone is readily able to contact and react with soap, dirt, soil, grime, germs, bacteria, etc., and the laundry 8 contained within the internal cavity 14 of the washing machine 4 during each wash cycle.

Preferably, a conventional air supply device/oxygen concentrator 48 compresses room air to about 5 pounds of pressure or so and supplies the pressurized room air, via a conventional duct or pipe 50, to an air flow control valve 52 which regulates the flow rate of the air being supplied to the washing machine 4. The air supply device/oxygen concentrator 48, during normal compression of the air, typically removes nitrogen for the air to increase the oxygen content of the air and this also facilitates subsequent production of ozone. The air supply device/oxygen concentrator 48 also typically removes water, moisture and other impurities from the air prior to supplying the same to the air flow control valve 52.

The air flow control valve 52 is connected, via a conventional duct or pipe 54, to supply the pressurized and regulated air to an inlet of the primary ozone generator 42 where a portion of such air, e.g., typically about 5% of the supplied air, is converted into ozone in a conventional fashion. As such conversion of air into ozone is conventional and well known in the art, a further detailed discussion concerning the same is not provided. An outlet of the primary ozone generator 42 is connected, via a conventional duct or pipe 56, to supply the generated ozone to the spargers 46 located within the sump 44 of the washing machine 4.

If desired, the air supply device/oxygen concentrator 48 may incorporate a drying unit which further assists with adequately drying the air, i.e., removes substantially all of the moisture therefrom, prior to supplying the same to the air flow control valve 52. Alternatively, a separate air drier unit 58 (see FIG. 5) may be provide somewhere along the air supply path, prior to the air being supplied to the primary ozone generator 42, to assist with removing moisture therefrom. As shown, the air dryer unit 58 and a conventional duct or pipe 59 are located between the air supply device/oxygen concentrator 48 and the air flow control valve 52.

Figure 6:
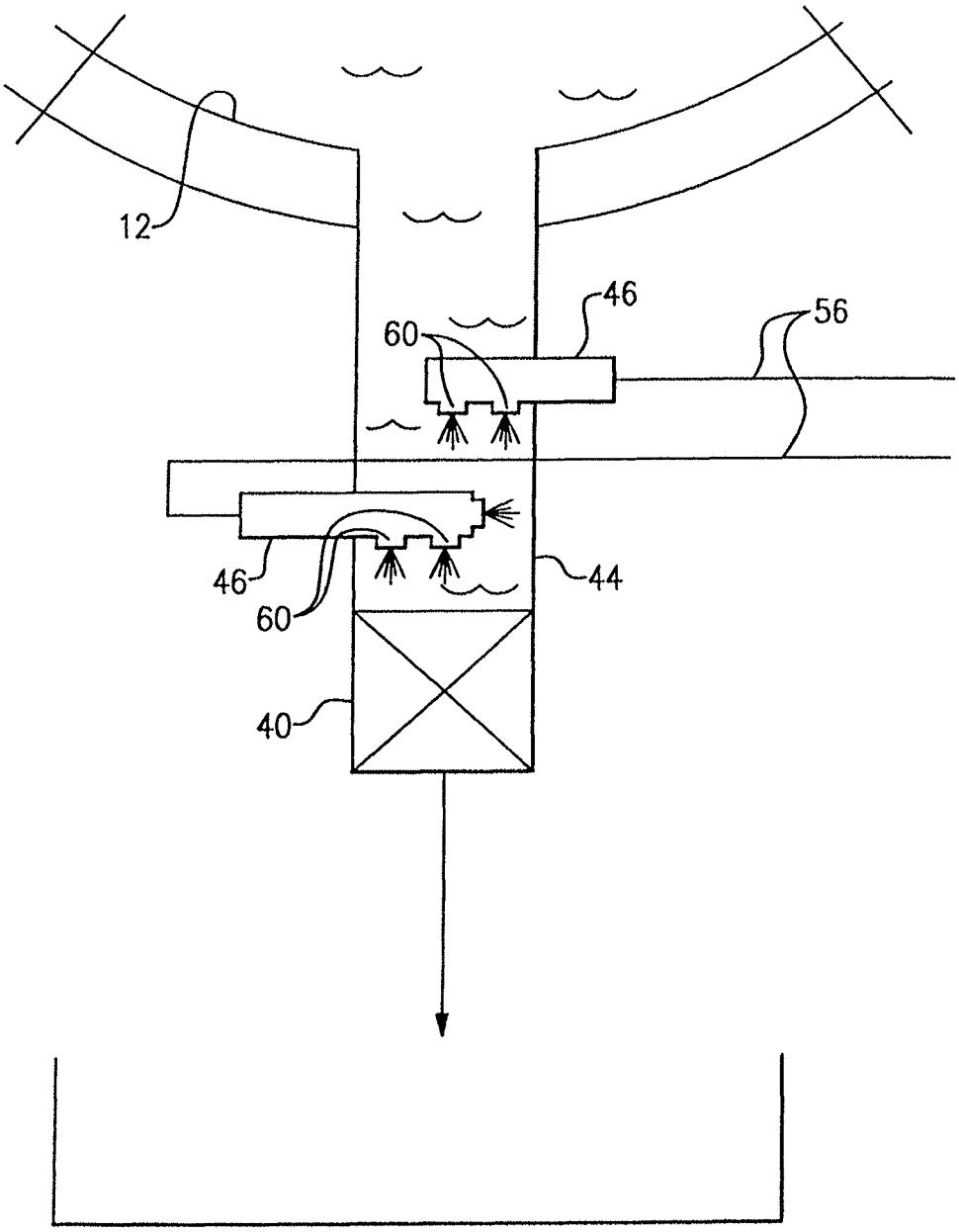
FIG. 6 shows injection of the ozone into the sump via the sparger injection nozzles.

The ozone, produced by the primary ozone generator 42, is supplied to the sparger or spargers 46 and injected into the water 6 contained within the sump 44 of the washing machine 4 via one or more injector nozzles 60 supported by the spargers 46 (see FIG. 6). Preferably, the injector nozzles 60 injects the ozone downwardly toward the drain valve 40 of the washing machine 4 to facilitate further suspension, entrainment, encapsulation, dispersion and/or mixing of the supplied ozone in the water 6 contained within the sump 44 and thereby provide a more uniform mixture and dispersion of the ozone within the water 6 contained within the sump 44 as well as throughout the entire water 6 contained within the washing machine.

The produced ozone typically has a particle size of about 2 microns to 20 microns such that some of the ozone is not readily dissolved, to any substantial extent, in the water 6 contained in the sump 44 but is encapsulated, suspended, dispersed and/or entrained within the water 6 and thus the ozone is readily available, in gaseous form, for reacting with any dirt, soil, grime, grease, germs, bacteria, etc., contained in the laundry 8 being washed by the washing machine 4. As is conventional, the ozone will only typically last fora relatively short time period of between about 2 to about 5 minutes or so before the ozone naturally converts back into oxygen and lose its disinfectant and/or sanitization capability.

To facilitate control of the amount of ozone generated, an ozone exhaust or sampling detector or sensor 62 is located in, immediately adjacent or near one of the conventional exhaust vent(s), port(s) or outlet(s) 64 of the washer machine 4, such as a soap vent, soap chute, an air bleed-off vent, etc. Alternatively, the ozone exhaust or sampling detector or sensor 62 can be either located within the washing machined or directly connected to a sampling outlet or aperture for periodically withdrawing a sample of gas from the washing machine and, once the ozone concentration of the washing machine is detected by the ozone exhaust or sampling detector or sensor 62, this withdrawn sample can then either be discarded or possibly return back to the washing machine. The ozone exhaust or sampling sensor 62 either directly communicates with or is typically located within or as close as possible to the sampling or exhaust outlet(s) 64 so as to obtain an undiluted sample of the ozone being sampled, removed or exhausted from the washing machine 4. The ozone exhaust or sampling sensor 62 will monitor the withdrawn sample or the air escaping or exhausting from the washer machine 4, during operation thereof, to detect the concentration of the ozone contained therein. In the event that the ozone concentration level of the air sampled or exhausting from the washing machine 4 is above the ozone target value, e.g., above a target value of 1.0±0.5 parts per million for example, the ozone exhaust or sampling sensor 62 will then convey a signal to a relay or a proportionally variable or adjustable component 66 (see FIG. 8) which controls the supply of electrical power to the primary ozone generator 42 so as to either "trip" and thereby temporarily interrupt further production of ozone by the primary ozone generator 42 for a sufficient period of time, e.g., any where from a few seconds to about thirty minutes or so, or modify, alter, vary or reduce the current production of ozone to a lower or reduced level until the ozone exhaust or sampling sensor 62 again detects a level of ozone within the washing machine 4 which is below the target value, e.g., detects an ozone level in the escaping air below 1.0 parts per million, for example.

Any ozone which collects on a detection surface of the ozone exhaust or sampling sensor 62 will typically remain there until such ozone eventually "burns off" or naturally converts back into oxygen over time by the natural ozone conversion process. Generally, the ozone will last anywhere between about 2 to about 20 minutes or so, e.g., typically lasting between 3 and 5 minutes, before the ozone naturally converts back into oxygen. As long as the ozone exhaust or sampling sensor 62 detects an excessive amount of ozone, e.g., an amount of ozone greater than the adjusted sensitivity position of the ozone exhaust or sampling sensor 62 (e.g., the ozone exhaust or sampling sensor 62 is typically set to detect from about 0.3 to about 1.0 parts per million of ozone, for instance), the ozone exhaust or sampling sensor 62 will maintain the relay or the proportionally variable or adjustable component 66 in an active or tripped state so as to prevent the supply of electrical power to the primary ozone generator 42 and thereby prevent the further production of additional ozone or alter the supply of power to the primary ozone generator 42 so as to reduce the rate of production of ozone. As soon as substantially all of the ozone (depending upon the sensitivity setting of the ozone exhaust or sampling sensor 62) which collects on the surface of the ozone exhaust or sampling sensor 62 has sufficiently "burned off" or dissipated therefrom, or the ozone exhaust or sampling sensor 62 otherwise detects an ozone level less than the ozone target value, the ozone exhaust or sampling sensor 62 will then discontinue sending a signal to the relay or the proportionally variable or adjustable component 66, which either temporarily interrupts or otherwise alters the supply of electrical power to the primary ozone generator 42 to modify, lower, reduce or discontinue further ozone production. As a result, the relay or the proportionally variable or adjustable component 66 again allows the electrical power to flow and be supplied to the primary ozone generator 42 and the primary ozone generator 42 then immediately commences production of additional ozone at the initial level for use during the current and any subsequent wash stage(s) or cycle(s) (both of which are hereinafter collectively referred to as "wash cycle(s)") of the entire wash cycle.

The system 2 is also equipped with an area ozone level detector or sensor 68 which monitors the level of the ozone contained within a room or an area accommodating the washing machine 4 or a plurality of washing machines 4, e.g., a laundry mat or some other commercial washing facility such as a hospital or a prison, for example. In the event that the area ozone level sensor 68 detects an excessively high or unsafe amount of ozone located within the room or the area accommodating the one or more washing machines 4, e.g., detects a room concentration level of ozone also above the ozone target value or some other common area target value, which is also currently typically in excess of 0.1 parts per million, the area ozone level sensor 68 will then convey a signal to a relay or a proportionally variable or an adjustable component 66 which "trips" or interrupt further production of ozone, or merely decreases or reduces the rate of production of ozone by each of the primary ozone generators 42 for a sufficient period of time, e.g., any where from a few seconds to about thirty minutes or so or possibly completely shuts down all further production of ozone, by any of the primary ozone generators 42 as well as all of the filling water ozone generators 30, of the washing machine(s) 4 until the area ozone level sensor 68 again detects a level of ozone in the room or the area accommodating the washing machine(s) 4 is below the common area target value. The sensitivity setting for the area ozone level sensor 68 is also typically adjustable but typically has a sensitivity range of between about 0.03 to about 0.1 parts per million or greater, for example. Alternatively, or in addition, the area ozone level sensor 68 will merely shut off or interrupt the supply of power to the air supply device/oxygen concentrator 48, which supplies the pressurized air to the primary ozone generator 42, as well as the air supply device/oxygen concentrator 36, which supplies the pressurized air to the filling ozone generator 30, and thereby interrupts all further production of ozone by the system 2, or may merely reduces the rate of further production of ozone.

This relay, or proportionally variable or adjustable component, 66 will remain tripped or activated until the area ozone level sensor 68 again determines that an acceptable level of ozone, below the common area target value, is currently present in the room or the area accommodating the washing machine(s) 4. Once this occurs, the area ozone level sensor 68 will discontinue sending a signal to the relay or the proportionally variable or adjustable component 66, which deactivates the relay or component 66 so that the relay or component 66 again allows power to flow to the ozone generator(s) 42 and/or the air supply device/oxygen concentrator 48 and to the ozone generator(s) 30 and/or the air supply device/oxygen concentrator 36 which then again allows further production or manufacture of additional ozone during the remainder of the wash step, stage or cycle. Alternatively, the area ozone level sensor 68 will discontinue sending a signal to the relay or the proportionally variable or adjustable component 66, which deactivates the relay or component 66 so that the relay or component 66 again allows the original flow of power to the ozone generator(s) 42 and/or the air supply device/oxygen concentrator 48 and to the ozone generator(s) 30 and/or the air supply device/oxygen concentrator 36 so they may resume normal production of ozone during the remainder of the wash step, stage or cycle. The area ozone level sensor 68 prevents a potentially hazardous condition from occurring during operation of one or more washing machines 4 due to the production and collection of excessive ozone within the room or the common area.

Preferably, the area ozone level sensor 68 is connected to a relay or a proportionally variable or adjustable component 66 which controls the supply of the modified/altered/interrupted electrical power to only the air supply device/oxygen concentrator 48 and/or the air supply device/oxygen concentrator 36 in order to control the production of the ozone during operation of the washing machine 4. As a result of such electrical power modification/alteration/interruption, the production of ozone is reduced, discontinued or interrupted since reduced or no pressurized air flows through the primary ozone generator 42 and the filling water ozone generator 30 and thus reduced or no ozone is produced by any of the ozone generators 30, 42 even though the ozone generators 30, 42 may still be supplied with electrical power. Alternatively, the relay or the proportionally variable or adjustable component 66, when tripped or activated by the ozone exhaust or sampling sensor 62 and/or the area ozone level sensor 68, can also be coupled to the primary ozone generator(s) 42 and the filling water ozone generator(s) 30, and/or the air supply device/oxygen concentrator(s) 36, 48 and/or the air flow control valve(s) 40, 52 so as also to control operation of all of those components and modify/alter/interrupt the supply of electrical power to one, two or all three of the primary ozone generator(s) 30, 42, the air supply device/oxygen concentrator(s) 36, 48 and/or the air flow control value(s) 40, 52 when an excessive amount of ozone is detected.

It is to be appreciated that there are a variety of different ways for reducing/modifying/altering/interrupting the production of ozone by the primary ozone generators 42. For example, the ozone exhaust or sampling sensor 62 and/or the area ozone level sensor 68 can activate a valve (not shown), located between the air flow control valve 52 and the primary ozone generators 42 which diverts all or only a portion of the supplied air directly to the spargers 46 so that the supplied fresh air and/or possibly some ozone can mix with the water 6 contained in the sump 44. The important aspect is that the system is controlled, in some manner, so as to reduce the production and/or supply ozone or completely discontinue the supply of ozone until the ozone exhaust or sampling sensor 62 and/or the area ozone level sensor 68 again detects a safe level of ozone, below the common area target value, both within the washing machine(s) 4 and within the room or the common area.

Although the target values for the ozone exhaust or sampling sensor 62 and the area level ozone sensor 68 are both currently 1.0 parts per million of ozone, it is to be appreciated that one or both of the ozone exhaust or sampling sensor 62 and/or the area level ozone sensor 68 could be a variable sensor. That is, as the ozone exhaust or sampling sensor 62 and/or the area level ozone sensor 68 detects the ozone level in the exhausting air or room approaching either 1.0 or 0.1 parts per million of ozone, or possibly some higher or lower level depending upon the requirements and/or the location of the sensor(s) or the settings setting of the particular sensor, the ozone sensor 62, 68 will issue a variable command to the primary ozone generator 42 which proportionally decreases or reduces the amount of ozone being produced and thereby continuously maintain a safe level of ozone which is either being exhausted from the washing machine and/or located within the room or area accommodating the washing machine(s) 4. It is to be appreciated that if the ozone sensor(s) 62 or 68 senses that the ozone level is only gradually approaching an unsafe level of ozone, the ozone sensor(s) 62 or 68 could send a signal which gradually reduces the production of ozone by the primary ozone generator 42 and/or the filling water ozone generator 30. If, however, the ozone sensor(s) 62 or 68 senses that the ozone level is rapidly approaching an unsafe level, the ozone sensor(s) 62 or 68 will issue a signal more rapidly reducing or possibly completely interrupting further production of ozone. Such variable control of the primary ozone generator 42 and/or the filling water ozone generator 30, by the ozone exhaust or sampling sensor 62 and/or the area level ozone sensor 68, tends to minimize the duration of time, if any, that the ozone generators 30, 42 are not actually producing any ozone during operation of the washing machine and tends to result in a more continuous supply of ozone to the washing machine to ensure that an adequate supply of ozone is always present in the washing machine during each wash cycle. That is, the ozone contained within the water 6 is generally within a control band which is typically between 50 and 100% of the ozone target value.

According to the present invention, it is desirable to control the production of ozone and supply the produced ozone to the washing machine 4 so that the amount of ozone contained within the water within the internal drum 12 of the washing machine 4 has the greatest practical amount of dissolved and/or encapsulated ozone therein which is at or slightly below the ozone target value. Such procedure ensures the highest CT value during the shortest possible wash cycle and thereby assist with maximum cleaning, sanitization and/or sterilization of the laundry 8.

Typically during a commercial wash cycle, generally there are about eight sequential wash steps, stages or cycles. The first stage or cycle is typically when the greatest amount or quantity of ozone is required and may be created by both the filling water ozone generator 30 and the primary ozone generator 42. According to the present invention, both the filling water ozone generator 30 and the primary ozone generator 42 may always be set to their highest possible ozone production levels so that the ozone generators 30, 42 produces a maximum amount of ozone, e.g., produce between about 4 grams per hour of ozone at an ozone concentration level of about 5% ozone, and such ozone is immediately available for use during the first wash stage or cycle. This ozone "relaxes" the laundry and activates the laundry detergent or soap and assists with rapidly "burning off" any dirt, grime, grease, soil, etc., as well as killing any infectious diseases, super bugs, germs and/or bacteria contained within the clothing or laundry 8 being washed.

In the event that either the ozone exhaust or sampling sensor 62 and/or the area ozone level sensor 68 determines that an excessive amount of ozone is present in either the air being exhausted or in the room or area accommodating the washing machine(s) 4, such ozone sensor 62 or 68 will send a signal to the relay or the proportionally variable or adjustable component 66 which modifies, alters, trips or possibly completely turns off the primary ozone generator 42 to reduce or prevent further production of ozone for a desired period of time, e.g., until an excessive amount of ozone is no longer detected by the ozone exhaust or sampling sensor 62 and/or the area ozone level sensor 68, or merely reduces production of ozone by the primary ozone generator 42. As is noted above, once the level of the ozone in the sampled or exhaust gas(es) and/or the room or area sufficiently decreases to below the ozone target value, then either or both the filling water ozone generator 30 and/or the primary ozone generator 42 will be again reactivated and allowed to commence further production of ozone or resumption of production of ozone at an increased amount and supply the same to the washing machine 4.

During the second and subsequent wash stages or cycles, since much of the dirt, grime, grease, soil, etc., has already been partially or completely removed from the clothing or laundry 8 and since much of the germs, bacteria, etc., have already been partially or completely killed, typically less ozone is required. The addition of extra ozone during the initial portion of the first wash stage or cycle assists with further "relaxing" the clothing or laundry 8 such that the clothing or laundry 8 more readily releases its dirt, grime, grease, soil, etc. As a result of this increase in the amount of ozone supplied during the first wash stage or cycle, a sufficient amount of ozone may still be present within the wash volume, contained within the internal drum 12, and/or within the clothing or laundry 8 at the end of the first wash stage or cycle so that either the ozone exhaust or sampling sensor 62 and/or the area ozone level sensor 68 detects excessive ozone being present in the washing machine and may possibly maintain the primary ozone generator 42 in an inactive state or a relatively low ozone production rate for one or more subsequent wash stages or cycles in a row or may maintain the primary ozone generator 42 in an inactive state or a reduced production state for an initial portion of each subsequent wash stage or cycle of the wash cycle so that no additional ozone, or only a smaller amount of ozone, is produced. Is to be appreciated that the filling water, during each subsequent wash cycle, may be initially ozonated prior to being added to the internal drum 12 of the washing machine 4. This filling process assists with maintaining a desired amount of ozone within the internal drum 12.

Figure 1:
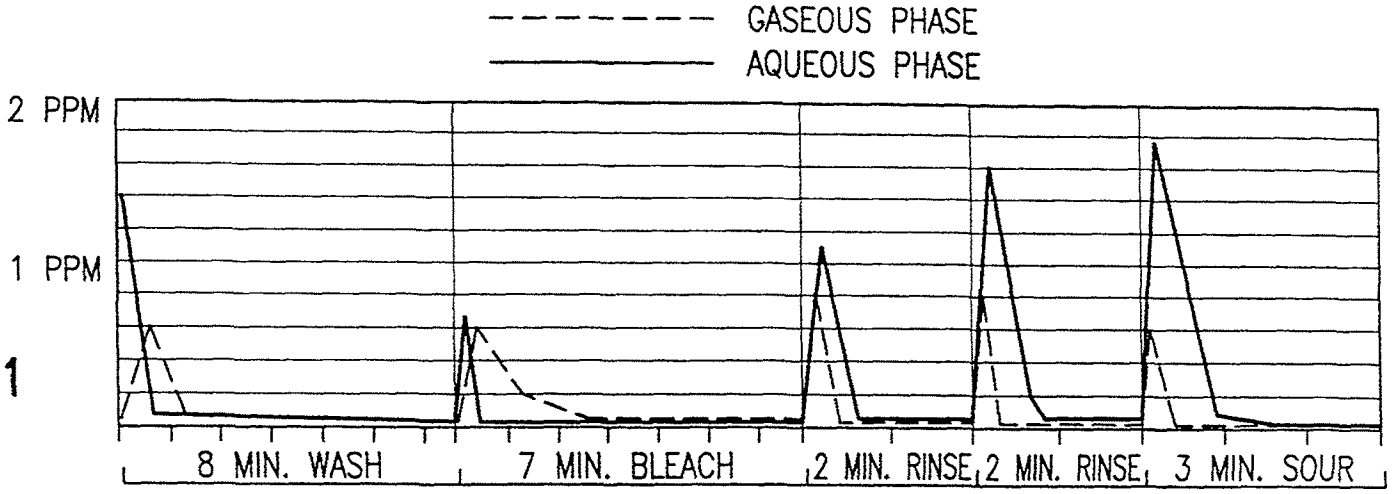
FIG. 1 is a diagrammatic drawing showing a gaseous ozone content level achieved by a prior art direct injection system.
Figure 2:
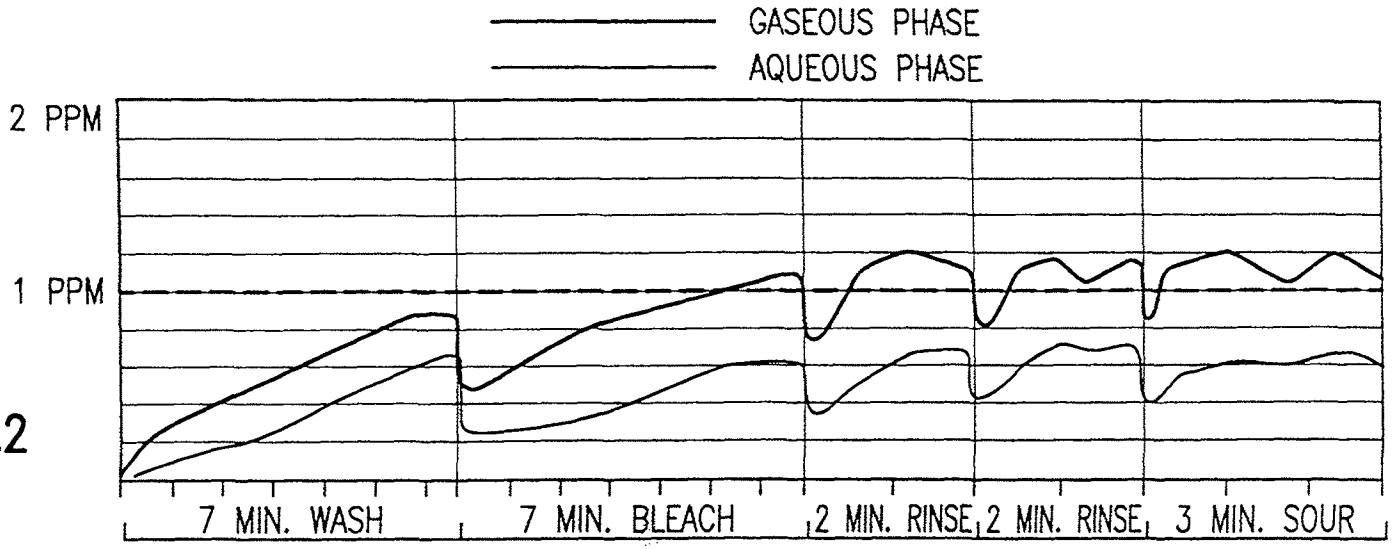
FIG. 2 is a diagrammatic drawing showing a gaseous ozone content level achieved by another prior art system.
Figure 7A:
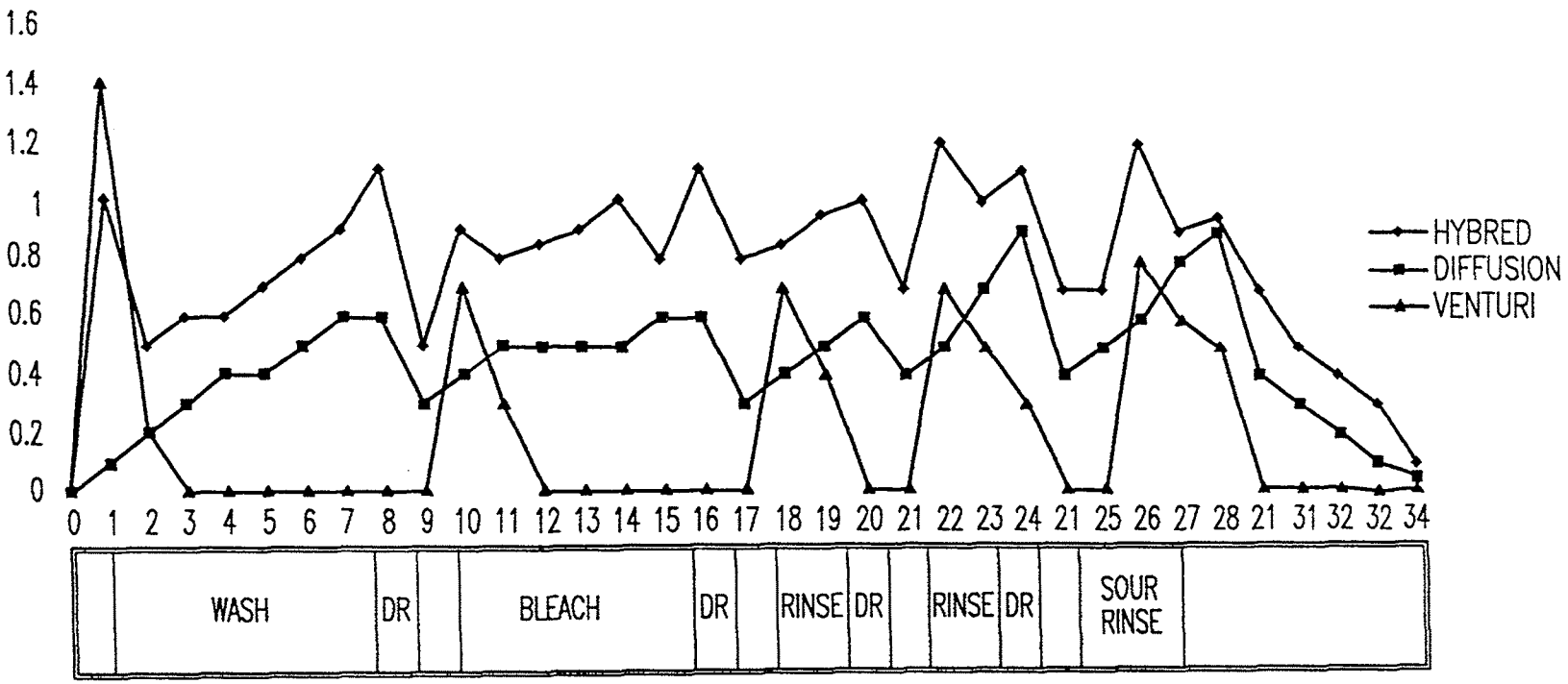
FIG. 7A is a graphic representation of the data shown in FIG. 7.

FIG. 7 is a table of date data showing a comparison of the gaseous ozone content, achieved by the present invention, in comparison to two prior art ozone systems. As shown in FIG. 7A, the improved CT value results, achieved by the washing machine according to the present invention, are depicted by the plotted uppermost graph results shown in that diagram, the plotted lowermost graph results shown in that diagram are in accordance with a prior art system similar to that shown in FIG. 1 while the plotted middle graph results shown in that diagram are in accordance with a prior art system similar to that shown in FIG. 2. As is readily apparent from this plotted uppermost graph results, the present invention is able to achieve and retain a much higher percentage of dissolved and/or encapsulated ozone within the water so that the average amount of ozone dissolved and/or encapsulated within the water constantly remains at a much higher level than that achieved by any prior other prior art system, i.e., the dissolved and/or encapsulated ozone remains within a control band which between 50% and 100% of the desired ozone target value. According to the present invention, the average amount of ozone, dissolved and/or encapsulated within the water, remains within a control band which is typically slightly above, at or slightly below the preset ozone target value of the system and this maximizes the CT value of the system and thereby improves the sterilization and/or disinfection of infectious diseases, germs, bacteria, etc., contained within the laundry 8. That is, the present invention controls the amount of ozone to have an average value which is generally between 50% and 100% of the ozone target value, more preferably the present invention controls the amount of ozone to have an average value which is generally between 60% and 100% of the ozone target value, and most preferably the present invention controls the amount of ozone to have an average value which is generally greater than 70%, e.g., is between 70% and 100%, of the ozone target value.

Figure 8:
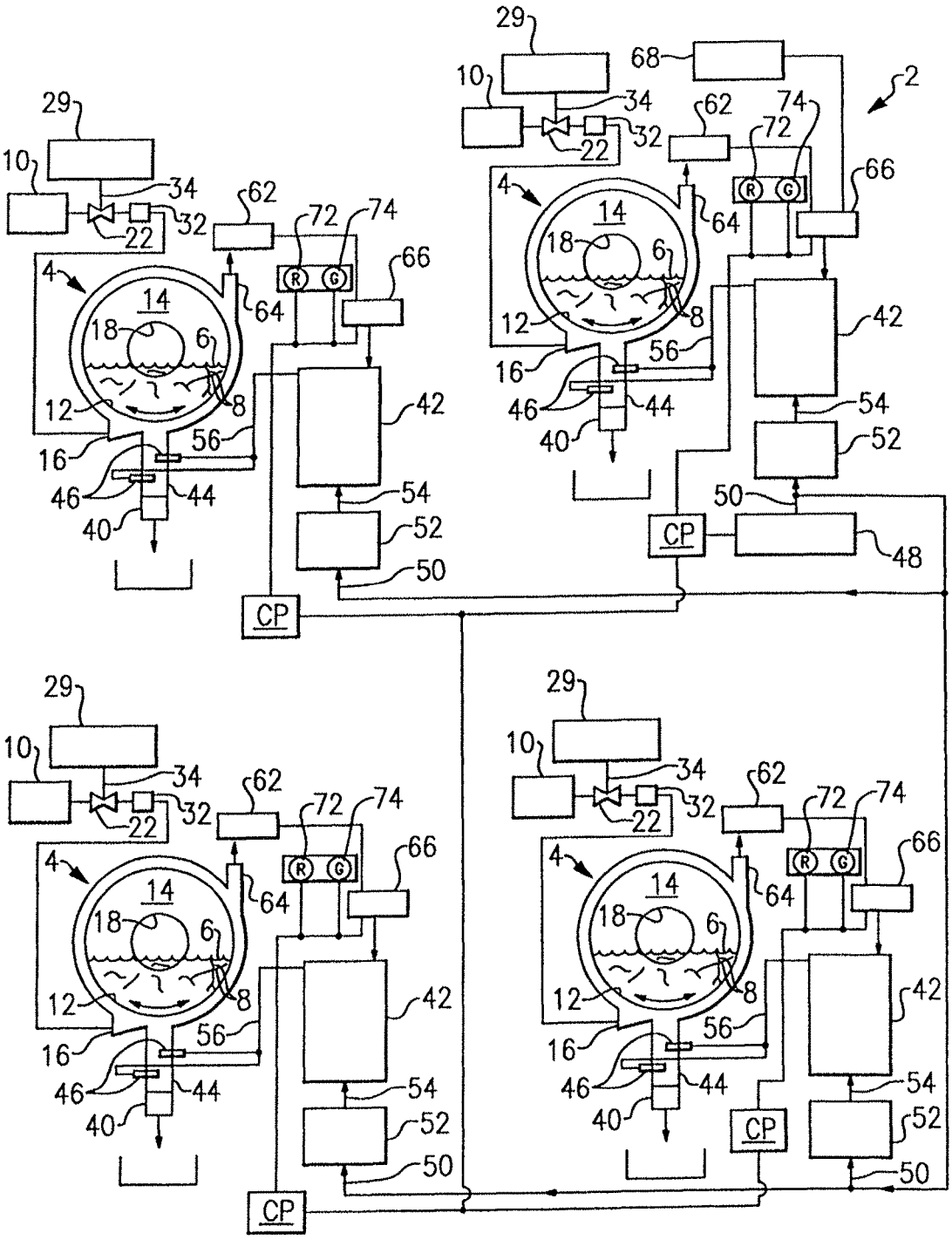
FIG. 8 shows an arrangement having a single area ozone level sensor for controlling or interrupting production of ozone by a plurality of washing machines.

With reference to FIG. 8, a description concerning a plurality of washing machines (only four of which are shown in the Figure) will now be discussed. According to this embodiment, a single air supply device/oxygen concentrator 48 generates an adequate supply of compressed air and supplies the compressed air, via conventional ducts or pipes 50, to all (e.g., four) of the individual air flow control valves 52, which each, in turn, regulate the flow rate of the air being supplied to each respective washing machine 4. Each air flow control valve 52 is connected, via a respective conventional duct or pipe 54, to supply the regulated air to an inlet of a respective primary ozone generator 42 where the air is converted to ozone, as discussed above, and supplied, via conventional duct or pipe 56, to the sump 44 and/or internal drum of the respective washing machine 4. As with the previous embodiment, each one of the washing machines is equipped with an ozone sample sensor of an ozone exhaust or sampling sensor 62, which is provided either within the internal drum 12, along or within an exhaust duct, or along, within or adjacent an exhaust vent, an outlet, a sampling port or any other aperture 64 of the respective washing machine 4. In the event that the ozone exhaust or sampling sensor 62 detects an excessive amount of ozone, this sensor will control the associated ozone generator 42 to reduce or completely interrupt the further production of ozone until the ozone concentration level of the air sampled or exhausting from the washing machine 4 again returns back below the ozone target value.

In addition, according to this embodiment, all of filling water for each one of the washing machines 4 typically passes through a respective venturi 22 (although this is not mandatory) where the water is accelerated, via the constriction 24 of the venturi 22, and such acceleration of the water induces a vacuum in the supply line 34 which draws in ozone which is supplied from the ozone system 29, incorporating the filling ozone generator 30, to the venturi inlet 28 of the venturi 22, as discussed above with the previously described embodiment. The ozone and the water then decelerate and initially commence intimate mixing with one another and the water/ozone mixture then passes through a static mixer 32. As the water/ozone mixture passes through the static mixer 32, the ozone is further intermittently mixed, dissolved, encapsulated and/or dispersed within and throughout the water and the static mixer thereby facilitates a more complete and thorough dissolving and/or encapsulation of the ozone within the water. As the ozone and water mixture exits the static mixer 32, preferably this mixture undergoes a dwell time of about 3 seconds, plus or minus one second, as described above.

As with the previous embodiment, the filling ozone generator 30 is connected to the venturi inlet 28 of the venturi 22 via an ozone supply line 34 for supplying ozone thereto. Typically, the filling ozone generator 30 will constantly and continuously produce ozone during the entire operation of the washing machine 4 and such produced ozone is normally retained within the filling ozone generator 30 and only withdrawn from the filling ozone generator 30 when required, e.g., as water passes through the venturi 22 and sucks the ozone from the filling ozone generator 30. Each filling ozone generator 30 is electrically connected to the control panel CP to facilitate both control and operation of all the filling ozone generators 30 and all of the primary ozone generators 42 as well as facilitate varying, modifying, altering or interrupting production thereof in the event that a hazardous situation arises.

As discussed above, the ozone system 29 includes a conventional air supply device/oxygen concentrator 36 for compressing room air and an air flow control valve 40 for regulating the flow rate of the air being supplied to filling ozone generator 30. As these components operate in the same manner discussed above, further discussion concerning the same is not provided again.

According to this embodiment, generally only a single area ozone level sensor 68 monitors the level of the ozone contained in the common area accommodating all (e.g., four) of the washing machines 4. In the event that the area ozone level sensor 68 detects an unsafe amount of ozone contained within the room or the area accommodating the washing machines 4, the area ozone level sensor 68 will send a signal to a second relay or proportionally variable or adjustable component 70 which is connected with the single air supply device/oxygen concentrator 48. The second relay or proportionally variable or adjustable component 70 reduce, alters, adjusts, modifies or completely interrupts the flow of electrical power to the single air supply device/oxygen concentrator 48 and thus the flow of air to each one of the (e.g., four) primary ozone generators 42 so that none of the primary ozone generators 42 is thereafter able to manufacture any further ozone or they produce a reduced quantity of ozone. It is to be appreciated that the flow of air and/or electrical power to the filling ozone system 29 is also typically interrupted, modified, altered or varied. Such reduction, alteration, modification or interruption in the production of ozone will continue until the area ozone level sensor 68 again determines that a safe level of ozone, below the target value, is now contained within the room. Thereafter, the flow of electrical power to the single air supply device/oxygen concentrator 48 and/or the filling ozone system 29 is again established back to their original levels and all the filling and primary ozone generators 30, 42 are then able to continue with further manufacture ozone at the original level, provided that the ozone being sampled or exhausted from each respect washing machine 4 is still below the target value.

The ozone system 2 may be equipped with an indicator which provides a visual indication that substantially all of the super bugs, germs, bacteria and/or infectious diseases contained within the clothing or laundry 8 being washed has been killed. For example, the ozone system 2 may be equipped with separate "red" and "green" lights (labeled "R" and "G", respectively) 72 and 74, as shown in FIG. 8. Upon activation of the ozone system 2, one of the relays or the proportionally variable or adjustable components 66 supplies electrical power to the "red" light 72 to indicate visually to the operator that the clothing or laundry 8 being washed has not had sufficient contact time with the dissolved and/or encapsulated ozone and thus may still contain live super bugs, germs, bacteria and/or infectious diseases. The "red" light 72 will remain illuminated until the ozone system 2 determines, as described above, that the laundry 8 has had a sufficient contact time with the ozone contained within the wash water, e.g., a sufficient CT value has been achieved of 21, for example. Once the ozone system 2 determines that the laundry 8 has had a sufficient contact time with the ozone contained within the wash water, e.g., a sufficient CT value has been achieved for the laundry 8, the ozone system 2 will interrupt the supply of electrical power to the "red" light 72 and thereafter another the relay or the proportionally variable or adjustable component will be activated to supply electrical power to and illuminating the "green" light 74 which provides a visual indication to the operator that substantially all of the super bugs, germs, bacteria and/or infectious diseases, contained within the clothing or laundry 8 being washed, have been reliably killed. It is to be appreciated that the "red" light 72 will remain illuminated until the ozone system 2 determines that the air sampled or exhausting from the washing machine 4 has a desired ozone concentration level, e.g., an ozone concentration level at, slightly below or slightly above the target value, of 1.0 parts per million for example, for a desired duration of time. Typically, each time the door 18 is opened and/or closed, the ozone system 2 is reset, e.g., the system returns back to only illuminating the "red" light 72.

Figure 9:
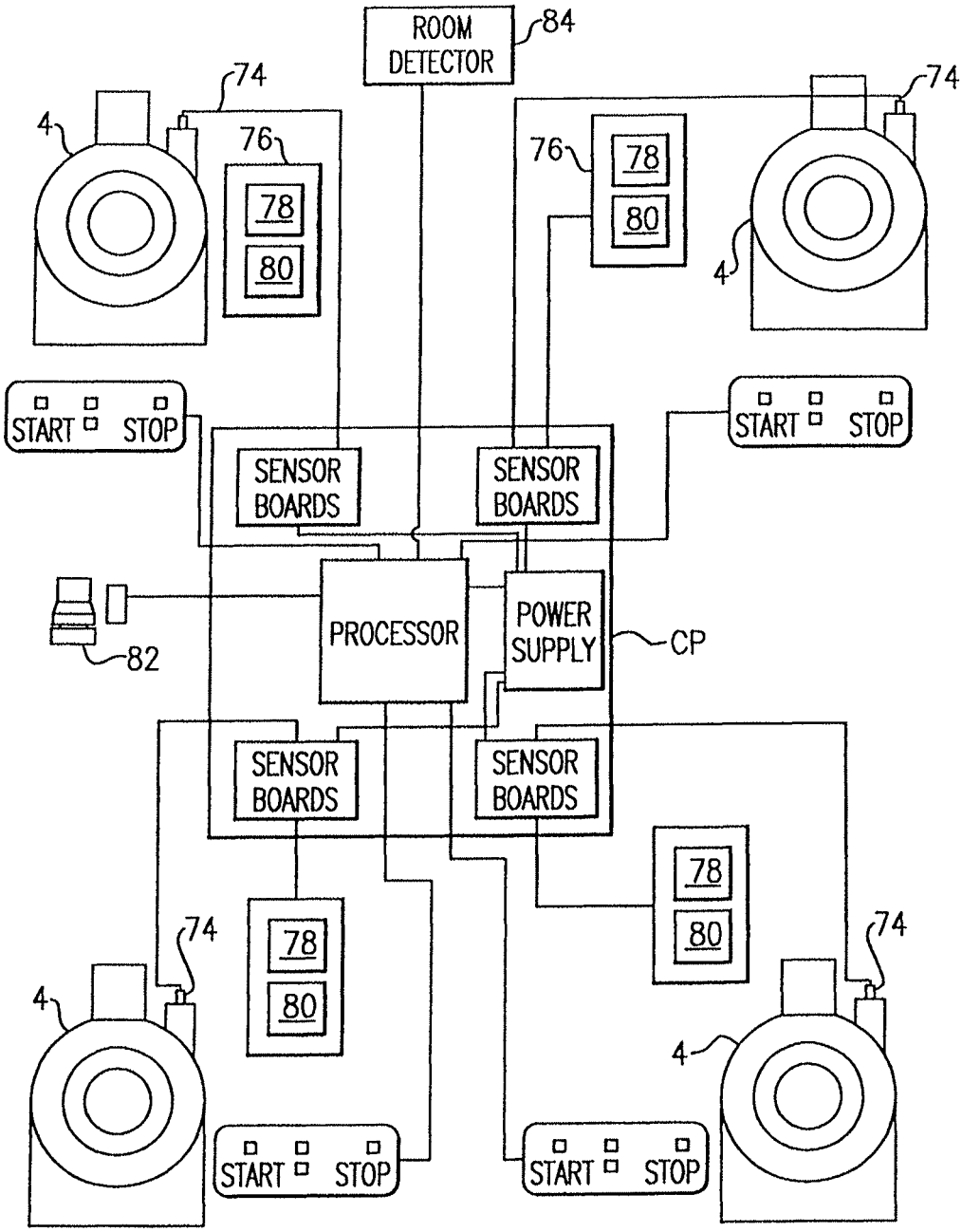
FIG. 9 is a diagrammatic arrangement for visually displaying both the currently detected CT value as well as the cumulative CV value during the entire wash cycle so that an operator can readily validate whether or not the laundry has been sufficiently washed so as to kill all commonly known infectious diseases.

With reference now to FIG. 9, a method and a system for continuously or intermittently detecting or measuring the ozone level, in the washing machine 4 during each wash cycle, will now be described. As shown in this Figure, the detectors 74 are located within, at or adjacent the exhaust vent 62, or any other aperture or opening, of each one of the washing machines 4 or communicate directly with the interior of the washing machine for sensing, monitoring or detecting an ozone content or concentration of the washing machine or an ozone content or concentration in the gases sampled from, or exiting or exhausting from the washing machine. The internal cavity 14 of each washing machine 4 is typically supplied with about 2 cubic feet of air per minute during the entire wash cycle. This supplied air facilitates sampling or exhausting some of the gassed off ozone from the internal cavity 14 of the washing machine 4 and the content of the ozone contained within this sampled or exhaust gas is then measured by the detector 74. The detector 74 continuously or intermittently detects, samples or measures the ozone level or concentration, e.g., the detector intermittently detects the ozone level in the sample or exhaust gases once a second, once every 2 seconds, once every 3 seconds, once every 4 seconds, once every 5 seconds, once every 10 seconds, once every 20 seconds, once every 30 seconds, once a minute, etc., to determine ozone readings of the washing machine and then calculate an average ozone reading. Preferably, the detector 74 detects the ozone level or reading of the washing machine(s) 4, in parts per million, once every second (i.e., 60 times a minute) and continues to send each one of these detected ozone levels or readings to a central processor of the control panel CP where each one of the detected ozone levels or readings is added with one another, in a register or some other processor, to obtain a summed total, e.g., for the third wash cycle, which lasts 3.5 minutes, 210 readings will be taken (the readings could be, for example, 0.9+0.9+0.95+0.95 0.9+0.9+0.95+0.9+0.9+0.95+0.95+0.95+0.95+0.95+1.0+ 1.0+1.0+1.1 . . . =206.87 ppm). This summed total, of all of the detected ozone values or readings, must then be divided by the total number of detected readings that the detector 74 actually detected the ozone level or reading of the washing machine(s) 4 in order to arrive at a "time wait average" (TWA) for the ozone, e.g., 210 readings (the total of 206.87 ppm/210 readings=0.985 (TWA)). The TWA for the ozone is then multiplied by the total duration of the current (third) wash cycle (e.g., 0.985 (TWA)×3.5 minutes) to generate the cumulative CT value for the current (third) wash cycle of 3.448. This cumulative CT value for the current (third) wash cycle is then summed with the cumulative CT value for each one of the previous wash cycles, e.g., a cumulative CT value of 3.876 for the first wash cycle+a cumulative CT value of 3.617 for the second wash cycle+a cumulative CT value of 3.448 for the current wash cycle for a current cumulative CT value of 10.941 for the entire wash cycle. This process is repeated for each wash cycle until all the wash cycles are complete and a total cumulative CT value for the entire wash cycle can be calculated and displayed.

The above procedure is repeated for each one of the wash cycles and, as noted above, the calculated current CT value for each wash cycle are added with one another to determine the cumulative CT value for the washed laundry 8 during the entire wash cycle, i.e., from the beginning of the first wash cycle to the end of the wash cycle which terminates when the door 18 is opened to provide access the laundry 8. The detector 74 is preferably coupled to a visual display 76 which can instantaneously display the both currently detected cumulative CT value 78 for the current wash cycle and may have a second display which displays a running total of the cumulative CT value 80 for the entire wash cycle, which includes all current as well as all previous wash cycle(s).

Preferably all of this information is logged into the control panel CP or an optional computer 82 for later referencing by service personnel to verify the current and cumulative CT values 80 for each wash performed by each one of the washing machines 4. This determination of the cumulative CT value is initiated as soon as the start button is actuated and the method and the system continue detecting, sampling and/or measuring the ozone level or concentration in the sample or exhaust gases being exhausted from the washing machine 4 until either the final wash cycle is completed or the washing machine 4 discontinues operation for some reason.

Figure 10:
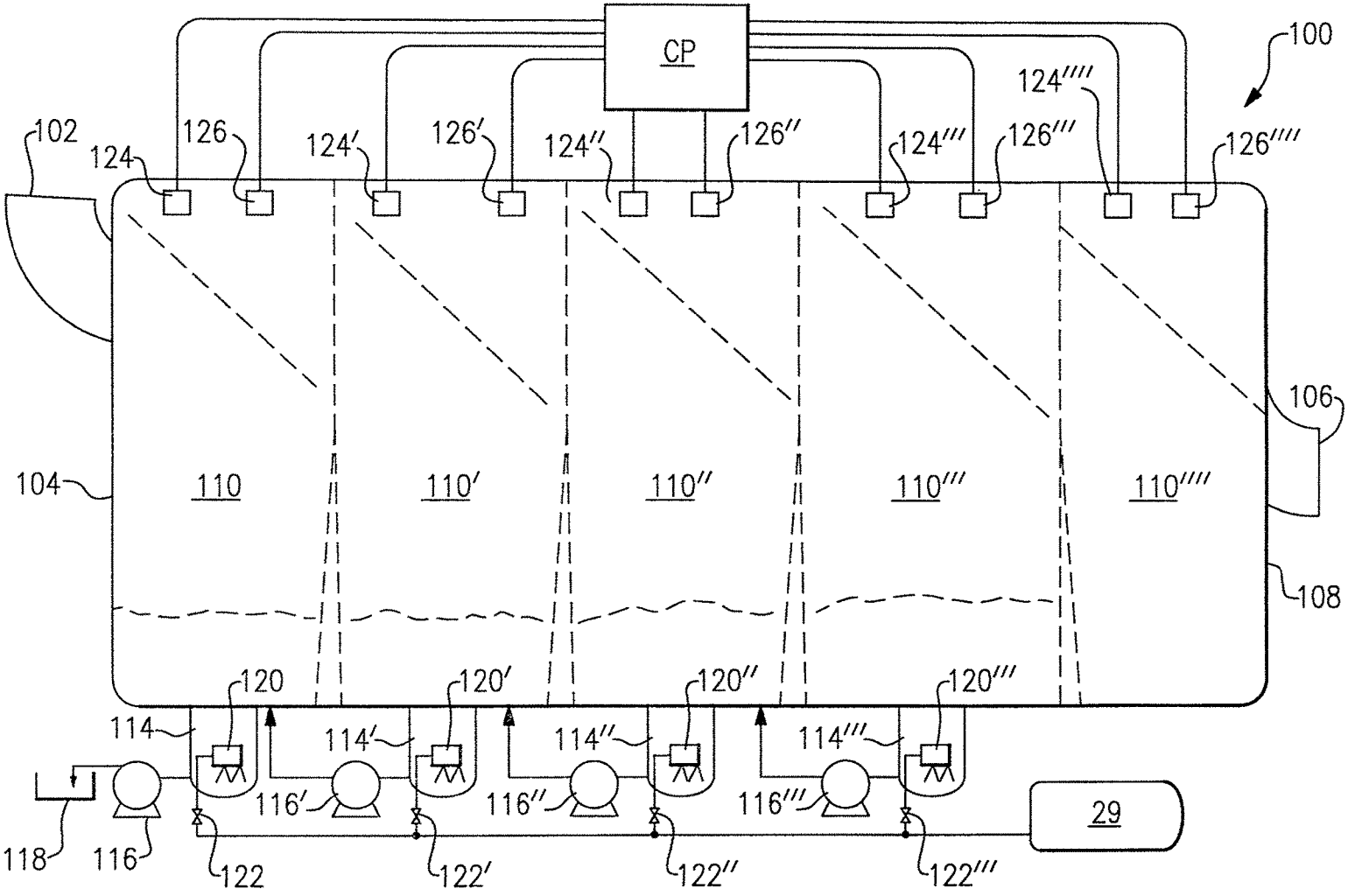
FIG. 10 is a diagrammatic view showing a modification of the present invention for use in combination with a conventional tunnel washer or a continuous batch.

With reference now to FIG. 10, a detail description concerning use of the present invention in connection with a tunnel or a continuous batch washer will now be described. As generally shown in FIG. 10, the continuous washing machine 100 generally comprises a laundry inlet 102, adjacent an inlet end 104 of the continuous washing machine 100, and a laundry outlet 106 located adjacent the opposite outlet end 108 of the continuous washing machine 100. The laundry inlet 102 and the laundry outlet 106 are both interconnected with one another by a conventional wash tunnel or rotatable drum which has a plurality of separate and distinct internal pockets, regions or zones 110, (i.e., a first zone 110, a second zone 110', a third zone 110", a fourth zone 110''', a fifth zone 110", etc., and each of which is hereinafter referred to as a "zone") formed therein.

During operation of the continuous washing machine 100, the laundry 8 is either manually or continuously supplied via a conveyer to the laundry inlet 102 and the laundry 8 progressively and sequentially travels or moves toward the laundry outlet 106 and is periodically transferred, by a conventional transfer system or mechanism 112 of the continuous washing machine 100, from one zone 110, 110', 110", 110''', 110'''', etc., to the next adjacent zone 110, 110', 110", 110''', 110'''', etc. While the laundry 8 located within each one of the separate zones 110, 110', 110", 110''', 110'''', etc., the laundry 8 is typically rotated back and forth for a desired duration of time in order to wash, clean, sterilize and/or sanitize the laundry 8 contained within that respective zone 110, 110', 110", 110''', 110'''', etc., in a conventional fashion and thereby assist with progressively and gradual cleaning, sterilizing and/or sanitizing the laundry 8.

As is conventional in the art, fresh water is generally introduced into the continuous washing machine 100 adjacent the laundry outlet end 108 and such fresh water gradually flows along the continuous washing machine 100 toward the laundry inlet end 104. In addition, soiled water is periodically discharged from the first zone 110 of the continuous washing machine 100, located adjacent the laundry inlet end 104, during a wash cycle and such discharge soiled water is either reclaimed and/or recycled for use again with the continuous washing machine 100 or discharged into a sewerage system in a conventional manner. As such reclamation, recycling or discharge process is conventional and well known in the art, further detailed discussion concerning the same is not provided.

As is well known in the art, the laundry 8 will typically remain within each one of the separate zones 110, 110', 110", 110''', 110'''', etc., for a predetermined amount of wash time, e.g., typically between 1 and 5 minutes, for example. The duration of wash time within each one of the separate zones is typically dependent upon a number of factors, such as, the amount laundry 8 to be wash, the amount of zones 110, 110', 110", 110''', 110'''', etc., provided within the continuous washing machine 100, the amount of water to be utilized during the wash process, the overall size and capacity of the washer 100, etc. After expiration of the desired wash time, the laundry 8 is then "scooped up" and transferred, by a conventional transfer system or mechanism 112, into the next adjacent zone 110 located toward the laundry outlet end 108 of the washing machine. The water contained within each one of the respective zones 110, 110', 110", 110''', 110'''', etc., on the other hand, is then conveyed from a sump of that zone into the next adjacent zone located toward the laundry inlet end 104 of the continuous washing machine 100, as discussed below in further detail. As a result of such arrangement, the laundry 8 generally flows from the laundry inlet end 104 toward the laundry outlet end 108 while the water generally flows from the laundry outlet end 108 toward the laundry inlet end 104 of the continuous washing machine 100.

A detail description concerning first and second zones 110, 110' of the continuous washing machine 100, located adjacent the laundry inlet end 104 and incorporating features of the present invention, will now be discussed. It is to be appreciated the each adjacent pair of zones operate in a similar fashion and the total amount of zones, incorporated into the continuous washing machine 100, can vary from application to application 100.

As shown therein, a first zone sump 114 is located within the bottom portion of the first zone 110 while a second zone sump 114' is located within the bottom portion of the second zone 110'. A second zone water pump 116' is connected to the second zone sump 114' and the second zone water pump 116', when activated by the control panel CP, pumps the water contained with the second zone sump 114' into the first zone 110 (if desired, this water may be temporary pumped to and stored in a storage tank while the laundry 8 is transferred from one zone 110, 110', 110", 110''', 110'''', etc., to the next zone 110, 110', 110", 110''', 110'''', etc.). A first zone water pump 116 is also connected to the first zone sump 114 and the first zone water pump 116, when activated by the control panel CP, pumps the water contained within the first zone sump 114 either to a water reclamation system or directly discharges the pumped water into a sewerage system (both of which are diagrammatically represented in FIG. 10 as reference numeral 118). Alternatively, the first zone water pump 116 may be replaced by a drain (not shown) which merely discharges the water directly into the drainage or sewerage system 118. Each one of the other zones 110", 110''', 110'''', etc., of the continuous washing machine 100 is also similarly equipped with a respective water transfer equipment described above.

A second zone sparger 120' is located within the second zone sump 114' and is connected, via a conduit, to a supply of ozone, such as an air supply device/oxygen concentrator and/or the filling ozone system 29. A first zone sparger 120 is located within the first zone sump 114 and is connected, via a conduit, to a supply of ozone, such as the air supply device/oxygen concentrator and/or the filling ozone system 29. A second zone flow valve 122' controls the flow of ozone from the supply of ozone 29 to the second zone sparger 120'. The second zone sparger 120' facilitates supplying ozone directly into the water located within the second zone sump 114'. A first zone sparger 120 is located within the first zone sump 114 and is connected, via a conduit, with the supply of ozone 29. A first zone flow valve 122 controls the flow of ozone from the supply of ozone 29 to the first zone sparger 120. The first zone sparger 120 facilitates supplying ozone directly into the water located within the first zone sump 114. Each one of the other zones 110", 110''', 110'''', etc., of the continuous washing machine 100 is also similarly equipped with a respective sparger described above.

A second zone ozone monitor 124' is typically located within the second zone 110' and is connected, via conventional electrical wiring, with either a computer or the control panel CP. The second zone ozone monitor 124' is typically located in the upper region of the second zone 110' and monitors the amount of ozone contained within the second zone 110' during operation of the continuous washing machine 100. The detected measurement of ozone is either recorded or conveyed to the control panel CP and used to determine or calculate the CT value for the laundry 8 contained within the second zone 110', in the manner described above and below. A first zone ozone monitor 124 is located within the first zone 110 and is also connected, via conventional electrical wiring, with either a computer or the control panel CP. The first zone ozone monitor 124 is typically located in the upper region of the first zone 110 and monitors the amount of ozone contained within the first zone 110 during operation of the continuous washing machine 100. The detected ozone value of the first zone 110 is either recorded on a computer, for example, or conveyed to the control panel CP and used for determining or calculating the CT value for the laundry 8 located within each of the first and the second zones 110, 110', in the manner described above and below. Each one of the other subsequent zones 110", 110''', 110'''', etc., of the continuous washing machine 100 is also similarly equipped with a respective ozone monitor described above.

A second zone ozone controller 126' is located within the second zone 110' and is connected, via conventional electrical wiring, with the control panel CP. The second zone ozone controller 126' is typically located in the upper region of the second zone 110' for controlling the amount of ozone supplied to the second zone sparger 120' during operation of the continuous washing machine 100. A first zone ozone controller 126 is located within the first zone 110 and is connected, via conventional electrical wiring, with the control panel CP. The first zone ozone controller 126 is typically located in the upper region of the first zone 110 for controlling the amount of ozone supplied to the first zone sparger 120 during operation of the continuous washing machine 100. Each one of the other subsequent zones 110", 110''', 110'''', etc., of the continuous washing machine 100 is also similarly equipped with a respective ozone controller described above.

It is to be appreciated that the ozone monitor and the ozone controller can be combined with one another, into a single sensor, for detecting both the amount of ozone contained within the respective zone 110, 110', 110", 110''', 110'''', etc., as well as controlling the amount of ozone to be supplied to the respective zone 110, 110', 110", 110''', 110'''', etc., without departing from the spirit and scope of the present invention.

Typically the last zone 110, 110', 110", 110''', 110'''', etc., of the continuous washing machine 100-110'''' in FIG. 10—comprises a conventional press zone 110''''. The press zone 110'''' facilitates pressing and/or squeezing water from the washed laundry 8 prior to discharging the laundry 8 from the laundry outlet 106 of the continuous washing machine 100. That is, the press zone 110'''' facilitates pressing, squeezing and/or removing most of the water contained within the laundry 8 prior to discharging the laundry 8 from the washing machine, somewhat similar to the water removal process achieved during a spin cycle of a conventional washing. As such press zone is conventional and well known in the art, further detail description can the same is not provided.

Operation of the continuous washing machine 100 will now be described briefly. According this embodiment, either ozonated water or fresh water can be supplied to the last wash zone 110''', i.e., the zone immediately before and adjacent the press zone, of the continuous washing machine 100. In either event, if additional ozone is required by any one of the separate zones during a currently wash stage or cycle, based upon a detected reading from the respective ozone monitor 124, 124', 124'', 124''', etc., such signal is communicated to the control panel CP which, in turn, opens the associated ozone flow valve 122, 122', 122'', 122''', etc., so as to permit the necessary flow of ozone to the respective the sparger tube 120, 120', 120'', 120''', etc., located in the respective zone sump 124, 124', 124'', 124''', etc., of the respective zone. The zone ozone controller 126, 126', 126'', 126''', etc., will facilitate both the supply, reduction and/or complete interruption of ozone to the respective sparger 120, 120', 120'', 120''', etc., located within the respective sump 124, 124', 124'', 124''', etc., of the respective zone 110, 110', 110'', 110''', 110'''', etc., in order to control the amount of ozone contained within each one of the respective zones. The ozone monitor 124, 124', 124'', 124''', etc., in turn, will periodically detect and record/transmit the detected amount of ozone, contained within the respective zone 110, 110', 110'', 110''', 110'''', etc., e.g., once a second, once every 5 seconds, once every 10 seconds, once every 20 seconds, once every 30 seconds, once a minute, etc. to the control panel CP for the entire duration of time that the laundry 8 remains in within respective zone and from such values or readings, the cumulative CT value for each zone as well as the cumulative CT value for the entire wash cycle are calculated.

Preferably, each respective ozone monitor 124, 124', 124'', 124''', etc., detects the ozone level or reading of the washing machine(s) 100, in parts per million, for each respective zone once every second (i.e., 60 times a minute) and continues to send each one of these detected ozone levels or readings to a central processor of the control panel CP where of the detected ozone levels or readings, for each respective zone, are added with one another, in a separate zone register or some other processor, to obtain a summed total for each respective zone. For a tunnel or a continuous batch washer, it is to be appreciated that the duration of each wash cycle is the same for each zone, e.g., each wash has a duration of 5 minutes for example, and a total of 300 readings will be taken for each wash cycle (e.g., the readings could be, for example, 1.0+1.0+1.0+1.1+1.0+1.0+1.0+1.1+1.0+1.0+1.0+1.1+1.05+1.0+1.0+1.0+1.05+1.0+1.0+1.0+1.1 . . . 316.87 ppm for the first zone, 331.70 ppm for the second zone, 315.78 ppm for the third zone and 305.55 ppm for the fourth zone). This summed total, of all of the detected ozone values or readings for each of the first, the second, the third and the fourth zones, must then be divided by the total number of detected readings actually detected in the washing machine(s) 100 to arrive at the time wait average (TWA) for the laundry within each one of the zones, e.g., 300 readings (a total of 316.87 ppm/300 readings=1.056 (TWA) for the first zone, a total of 331.70 ppm/300 readings=1.106 (TWA) for the second zone, a total of a total of 315.78 ppm/300 readings=1.053 (TWA) for the third zone, and 305.55 ppm/300 readings=1.019 (TWA) for the fourth zone.

The TWA for the laundry 8 located within each respective ozone is then multiplied by the total duration of the current wash cycle (e.g., 1.056 (TWA)×5 minutes) to generate a current cumulative CT value of 5.28 for the laundry 8 located within the first zone 110, a current cumulative CT value of 5.53 for the laundry 8 located within the second zone 110', a current cumulative CT value of 5.26 for the laundry 8 located within the third zone 110'' and a current cumulative CT value of 5.095 for the laundry 8 located within the fourth zone 110'''. The current cumulative CT value of 5.53 for the laundry 8 located within the second zone 110' is then summed with the cumulative CT value for that same laundry 8 when that laundry 8 was previously located within the first zone. The current cumulative CT value of 5.26 for the laundry 8 located within the third second zone 110'' is then summed with the cumulative CT value for that same laundry 8 when that laundry 8 was previously located within the second zone and the cumulative CT value for that same laundry 8 when that laundry 8 was previously located within the first zone 110. The current cumulative CT value of 5.095 for the laundry 8 located within the fourth second zone 110''' is then summed with the cumulative CT value for that same laundry 8 when that laundry 8 was previously located within the third zone, the cumulative CT value for that same laundry 8 when that laundry 8 was previously located within the second zone and the cumulative CT value for that same laundry 8 when that laundry 8 was previously located within the first zone. This process is repeated for each wash cycle until all the wash cycles are complete and a total cumulative CT value for the entire wash cycle can be calculated, as described above. and displayed.

The method and system, according to the present invention, preferably includes a variable adjustment or setting which allows the operator to adjust a target cumulative CT value to be achieved, following completion of the entire wash stage or cycle of the washing machine 4, 100, in order for the laundry 8 to be determined, or possibly "certified", as being adequately clean, deodorized and/or sanitized. In the event that the target cumulative CT value is not achieved, then the laundry 8 is determined as "failing" and thus typically has to be rewashed in a further attempt to achieve the target cumulative CT value where the laundry 8 can be determined or certified as "pass". Alternatively, the method and the system can communicate such failure information to the control panel CP of the associated washing machine 4, 100 which, upon receipt of such a communication, increases the wash duration of the final wash stage or cycle, e.g., adds a residual wash time of anywhere from a few minutes to as much as ten minutes or so, in an attempt to achieve or exceed the target cumulative CT value so the laundry thereafter can be certified as "passing", e.g., the green light can be illuminated, and thereby avoid the need for rewashing the laundry 8. For example, the cumulative CT value for the washing machine 4, 100 may be set to achieve a value of at least 21, 22, 23 or 24 to ensure that all of the infectious diseases listed in Table 1 are completely and thoroughly killed during the entire wash stage or cycle and the laundry 8 can be determined as being clean, deodorized and sanitized.

In addition, according to one embodiment of the invention, the area or the room detector 84 is provided and the room detector 84 communicates with the optional computer 82, if present, for later referencing by service personnel to determine whether or not any hazardous situations occurred within the room or common area and when and for how each such hazardous situation persisted, and/or with the control panel CP. The room detector 84 continuously or intermittently detects or measures the ozone level contained within the room, e.g., the room detector 84 intermittently the detects the ozone level in the exhaust gases contained within the room or common area once a second, once every 5 seconds, once every 10 seconds, once every 20 seconds, once every 30 seconds, once a minute, etc., to determine ozone readings as well as a calculated average ozone reading for the room or common area. This information is then recorded in a conventional storage device of the control panel CP, e.g., a buffer of the computer 82 or the control panel CP for example, for later access by service personnel as noted above.

It is to be appreciated, from the above description, that the ozone exhaust or sampling detector or sensor 62 is arranged so as to control, i.e., alter, modify and/or adjust, the production or the supply of ozone to the internal drum of the respective washing machine so at to maintain the concentration of ozone, within the internal drum of the washing machine, as close to, but generally below the target level, so that the laundry is completely washed and sanitized within the shortest duration of time. Such control can include a reduction in the current production or the current supply of ozone to the internal drum of the washing machine or a temporary interruption or discontinuance in production or supply of ozone to the internal drum of the washing machine.

It is further to be appreciated that the ozone exhaust or sampling detector or sensor for the washing machine is installed so as to be able to sense, monitor, sample or detect the concentration level of ozone either within internal drum or anywhere else within the washing machine, or in any sampling port or exhaust vent associated anywhere within or on the washing machine for sampling or detecting the washing machine ozone concentration level. The particular sampling port, exhaust vent or other aperture or opening is not important as long as the obtained sample or exhausted gas is not too dilute so that it does not accurately reflect the concentration level of ozone within the washing machine.

Figure 11:
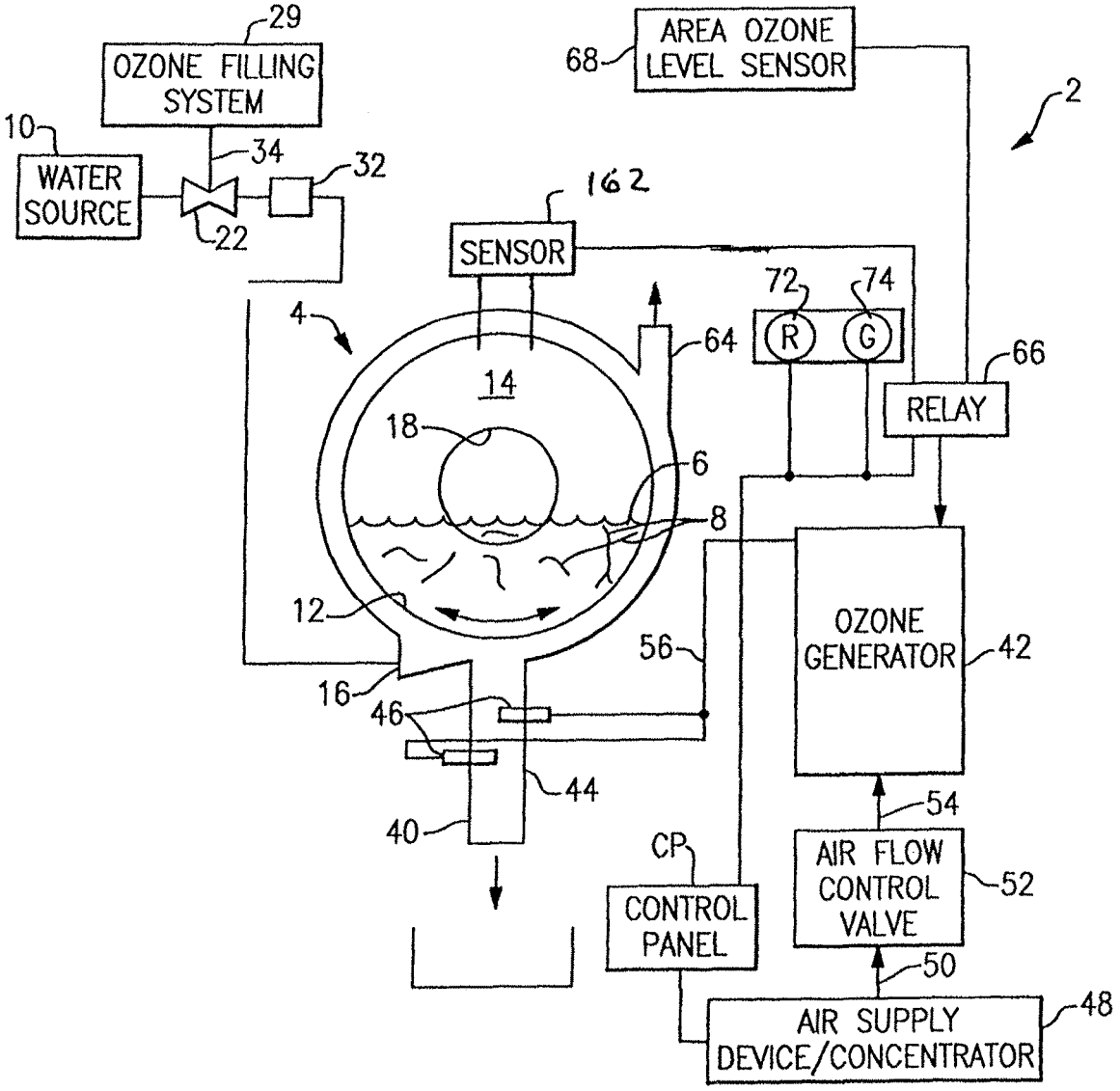
FIG. 11 shows an improved ozone sensing or detecting system, according to an embodiment of the present invention, for continuously detecting an undiluted sample of the ozone, contained within a contact chamber of the washing machine, and thereby facilitating a more precise control of the supply of ozone thereto.
Figure 12:
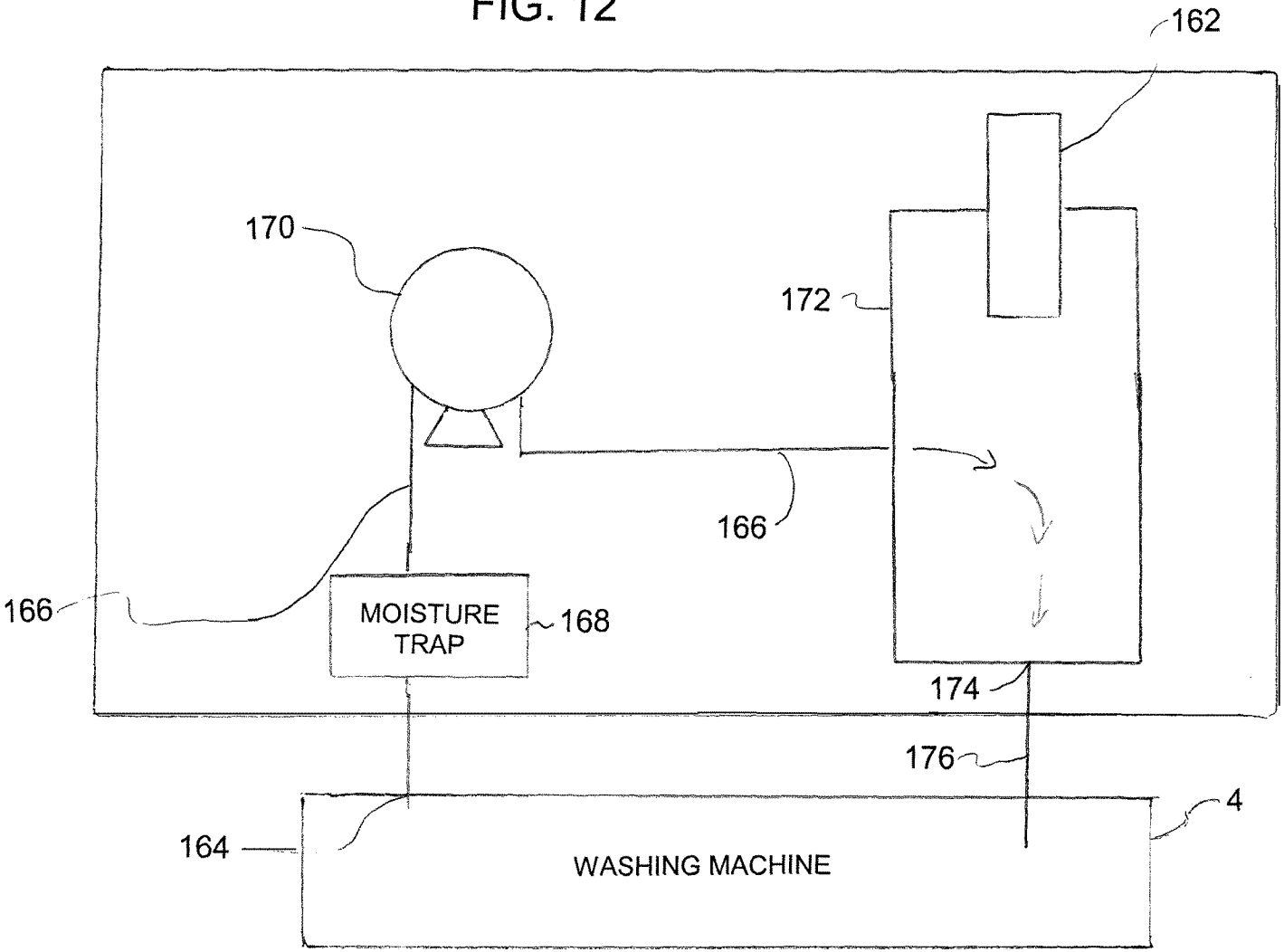
FIG. 12 diagrammatically shows the ozone sampling sensor or detector for detecting the ozone and returning the ozone back to the contact chamber of the washing machine.

Turning now to FIGS. 11 and 12, a brief description concerning a preferred location of the ozone sampling sensor or detector 162, for obtaining a substantially undiluted sample of ozone from a contact chamber of the washing machine, will now be described. As this embodiment is quite similar in many aspects to the embodiment discussed with respected FIGS. 3, 3A and 4, only the differences between this embodiment and that previously discussed embodiment will be discussed in detail.

As shown in FIG. 11, the primary difference between this embodiment and the embodiment of FIGS. 3, 3A and 4 is the location of the ozone sampling sensor or detector 162. According to this embodiment, the ozone sampling sensor or detector 162 is not located the sampling port or some other aperture 64 of the washing machine 4. Instead, an ozone sampling inlet 164 of the ozone sampling conduit 166, for drawing an ozone sample from the internal cavity 14 of the washing machine 4, is located inside and communicates with the contact chamber, i.e., the seal housing of the washing machine which contains the rotating internal drum 12 of the washing machine 4, so as to permit direct sensing or detection of the ozone which is interacting with laundry 8 being washed. Since the ozone sampling inlet 164 of the ozone sampling conduit 166 is located completely inside the washing machine 4, e.g., within the contact chamber of the washing machine 4, this prevents any room air from being sucked into the ozone sampling inlet 164, during the ozone sampling and/or detection, and thus facilitates collection of an undiluted withdrawn ozone sample from the washing machine 4.

Preferably, the ozone sampling inlet 164 of the ozone sampling sensor or detector 162 is located within the contact zone so as to minimize the possibility of any wash water 6, or other moisture for the washing machine 4, being drawn, sucked into or entering the ozone sampling inlet 164 of the ozone sampling sensor or detector 162. Accordingly, the ozone sampling inlet 164 of the ozone sampling sensor or detector 162 is typically along a rear end wall of the washing machine 4, generally in the vertically upper most portion or area of the housing enclosing the rotatable internal drum 12.

Preferably a moisture trap 168, or some other moisture removal device, is located along the first branch of the ozone sampling conduit 166, typically between the ozone sampling inlet 164 and an ozone sampling pump 170 and/or the ozone sampling sensor or detector 162. Such moisture trap 168, or other moisture removal device, facilitates removing moisture from the withdrawn ozone sample prior to such sample being supplied to the ozone sampling sensor or detector 162. It is to be noted that any moisture, contained in the supplied ozone sample, typically hinders the ability of the ozone sampling sensor or detector 162 to detect accurately and precisely detect the amount of ozone contained within the withdrawn ozone sample.

As shown in further detail in FIG. 12, a first branch of an ozone sampling conduit 166 couples a pump inlet, of the ozone sampling pump 170, with the ozone sampling inlet 164 located within the contact chamber. A pump outlet, of the ozone sampling pump 170, couples a second branch of the ozone sampling conduit to a sensor housing 172 which accommodates the ozone sampling sensor or detector 162. Typically, the ozone sampling sensor or detector 162 is located within an upper region of the sensor housing 172 and a leading sensor end, of the ozone sampling sensor or detector 162, extends vertically downward and toward a central region of an interior chamber of the sensor housing 172. The second branch of the ozone sampling conduit 166 is arranged so as to discharge the withdrawn ozone sample in a substantially horizontal direction into a central region of the sensor housing 172. Such discharge of the withdrawn ozone sample permits any water droplet(s), or other moisture contained within the supplied ozone sample, to fall due to gravity toward a lower region of the sensor housing 172.

A sensor housing outlet 174 is located in the lower region of the sensor housing 172 to facilitate removal of the withdrawn ozone sample from the sensor housing 172, following detection of the ozone concentration of the withdrawn ozone sample by the ozone sampling sensor or detector 162. An ozone return conduit 176 couples the sensor housing outlet 174, of the sensor housing 172, with the contact chamber of the washing machine 4 to facilitate returning the withdrawn ozone sample back to the contact chamber of the washing machine 4 so that such ozone can continue to clean, deodorize and sanitize the laundry 8 being washed.

Typically the ozone sampling pump 170 is able to withdraw an ozone sample from the washing machine 4 at a flow rate of about 16±10 liters per minute. The ozone sampling pump 170, during operation of the washing machine 4, continuously withdraws the desired withdrawn ozone sample from the washing machine 4 so that the ozone sampling sensor or detector 162 continuously detects the concentration of ozone contained within the withdrawn and supplied ozone sample and, in turn, the concentration of ozone contained within the washing machine 4. Such continuous sampling and detection facilitates a more precise detection and determination of the ozone contained within the wash water 6 and thus a more accurate determination of the contact value CT for the laundry 8 being washed in the washing machine 4.

Preferably, the ozone sampling sensor or detector 162 will output a signal of between 0-5 volts, depending upon the concentration of the detected ozone contained within the withdrawn ozone sample received from the washing machine 4, to the relay 66.

In addition to constantly and continuously sampling and detecting the amount of ozone contained within the wash water 6 and also continuously determining the contact value CT for the laundry 8 currently being washed, the present system and method are able to continuously record and store data concerning the all of the measurements made during each wash, e.g., ozone measurements, for each wash cycle of each washing machine 4. Such recorded and stored data permits verification of the determined contact value CT of each wash performed by any one of the washing machines 4.

Figure 13:
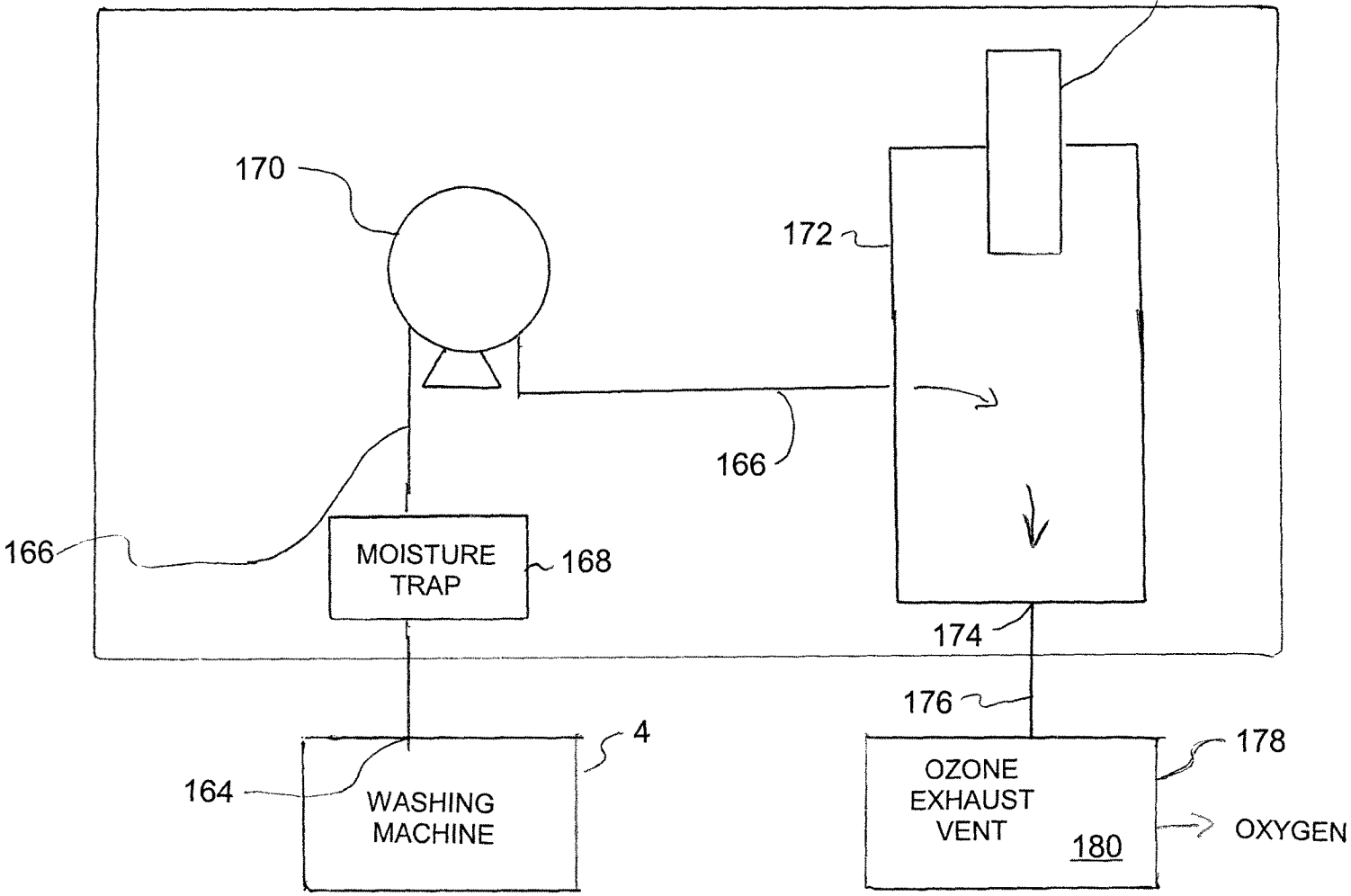
FIG. 13 diagrammatically shows the ozone sampling sensor or detector for detecting the ozone and destroying the sensed ozone prior to venting the same directly to the environment.

Turning now to FIG. 13, a brief description concerning a slight modification of the preferred location for the ozone sampling sensor or detector 162, according to FIGS. 11 and 12, will now be described. As this embodiment is quite similar in most respects to the embodiment of FIGS. 11 and 12, only the differences between this embodiment and the previous embodiment will be discussed in detail.

As shown in FIG. 13, the primary difference between this embodiment and the embodiment of FIGS. 11 and 12 relates to discharge of the withdrawn ozone sample following detection by the ozone sampling sensor or detector 62. According to this embodiment, the ozone return conduit 176, instead of returning the sensed ozone sample back to the contact chamber of the washing machine 4, supplies the sensed ozone sample to an ozone exhaust vent 178. The ozone gas exhaust vent is typically filled with charcoal, or some other conventional ozone destroying or destruction material 180, which readily destroys and/or converts the ozone, contained within the withdrawn and sensed ozone sample, back into harmless oxygen prior to discharging or venting the same directly into the room or the environment.

Since certain changes may be made in the above described improved ozone generating and monitoring system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A system for controlling a concentration of ozone of a washing machine so as to be at or below a target ozone concentration value, measured in parts per million, so that a cumulative contact time value, measured in parts per million multiplied by minutes, of the ozone with laundry being washed by the washing machine reaches a target contact time value over a duration of time in minutes of an entire wash cycle of the washing machine, thereby ensuring killing of any infectious diseases contained within the laundry, and the duration of time of the entire wash cycle being measured from a time the washing machine starts commences washing the laundry to a time the washing machine completes washing the laundry, and the entire wash cycle including an initial wash stage ac at least one subsequent wash stage, the system comprising:

a washing machine, for washing the laundry, having an internal drum for containing the laundry and a quantity of a water;

an ozone generator, connected to the washing machine, for supplying ozone to the washing machine to sanitize the laundry while assisting with the washing of the laundry;

the ozone generator supplying ozonated water to the washing machine upon initially filling the washing machine with filling water, and supplying additional ozone to the wash machine during at least one of the initial wash stage and the at least one subsequent wash stage;

an ozone sensor for sensing a current level of ozone in the washing machine during operation thereof;

a control panel being coupled to the ozone sensor and the ozone generator;

the control panel facilitating modification of production of ozone, based upon the sensed current level of ozone determined by the ozone sensor during each of the initial wash stage and the at least one subsequent wash stage, to be approximately equal to the target ozone concentration value;

the control panel determining, for each of the initial wash stage and the at least one subsequent wash stage, a current stage contact time value, and the control panel adding each of the current stage contact time values with one another to obtain the cumulative contact time value, and the control panel controlling operation of the washing machine so that the cumulative contact time value of the ozone with the laundry is at least 60% of the duration of time of the entire wash cycle; and if the cumulative contact time value of the ozone with the laundry is less than 60% of the duration of time of the entire wash cycle, then the control panel indicates that the laundry is not sanitized and the laundry must be rewashed.

2. The system for controlling the concentration of ozone of the washing machine to be at or below the target ozone concentration value according to claim 1, wherein the ozone sensor senses an amount of ozone in air either contained in exhausting from the washing machine and, in an event that the concentration of ozone in the air either contained in or exhausting from the washing machine exceeds the target ozone concentration value, the control panel modifies the supply of ozone to the washing machine until the ozone sensor again senses that a current concentration of the ozone in the air either contained in or exhausting from the washing machine is at or below the target ozone concentration valve.

3. The system for controlling the concentration of ozone of the washing machine to be at or below the target ozone concentration value according to claim 1, wherein the system further comprises an area ozone level sensor which detects a level of ozone contained within an area accommodating the washing machine, and, in an event that the area ozone level sensor detects an excess level of ozone contained in the area, the control panel modifies the production of ozone until the area ozone level sensor again senses the concentration of the ozone in the area accommodating the washing machine is below a safe level of ozone.

4. The system for controlling the concentration of ozone of the washing machine to be at or below the target ozone concentration value according to claim 1, wherein the duration of the entire wash cycle is between 25 and 40 minutes, and the cumulative contact time value is at least 15 parts per million multiplied by minutes.

5. The system for controlling the concentration of ozone of the washing machine to be at or below the target ozone concentration value according to claim 1, wherein the system only supplies ozonated water to the washing machine each time the washing machine is filled during the initial stage and during each of the at least one subsequent wash stage; and a venturi facilitates initial mixing of the ozone with the filling water to form the ozonated water, and the ozonated water is then supplied to a static mixer where the ozone is further intimately mixed and encapsulated within the filling water prior to the ozonated water being discharged into the washing machine.

6. The system for controlling the concentration of ozone of the washing machine to be at or below the target ozone concentration value according to claim 5, wherein the ozonated water, once the ozonated water exits from the static mixer, is provided with a dwell time of between about 2 seconds to about 4 seconds, to increase further intimate mixing and encapsulation of the ozone within the filling water, prior to the ozonated water being discharged into the washing machine.

7. The system for controlling the concentration of ozone of the washing machine to be at or below the target ozone concentration value according to claim 1, wherein:

any additional ozone, supplied to the washing machine, is injected into the water located within the washing machine, and the control panel controls the supply of the ozone to the washing machine when a monitored concentration of ozone within the washing machine exceeds the target ozone concentration value; and the supply of ozone to the wash machine is controlled so that the monitored concentration of ozone, within the washing machine, is within a band between 70% and 100% of the target ozone concentration value and the cumulative contact time value (parts per million multiplied by minutes) of the ozone with the laundry is at least 70% of the duration of time of the entire wash cycle.

8. The system for controlling the concentration of ozone of the washing machine to be at or below the target ozone concentration value according to claim 1, wherein the cumulative contact time value (parts per million multiplied by minutes) of the ozone with the laundry being washed is at least 21 parts per million multiplied by minutes to ensure killing of any infectious diseases contained within the laundry.

9. A system for controlling a concentration of ozone in contact with laundry being washed thereby ensuring killing of any infectious diseases contained within the laundry, the system comprising:

a washing machine having an internal drum encased within an external housing for containing the laundry and a quantity of a water;

an ozone generator, connected to the washing machine, for supplying the ozone to the washing machine, the ozone generator supplying the ozone to the washing machine via ozonated water when the washing machine is initially filled with filling water during an initial wash stage, and the ozone generator further supplying additional ozone to the wash machine during each at least one subsequent wash stage of an entire wash cycle, and the entire wash cycle comprising the initial wash stage, the at least one subsequent wash stage and a final wash stage;

an ozone sensor communicating with the internal drum for sensing at least a current ozone level in the internal drum during each wash stage;

a control panel being coupled to the ozone sensor and to the ozone generator;

the control panel facilitates modifying production of ozone, based upon the sensed current ozone level determined by the ozone sensor, during each wash stage, so that the ozone level for each wash stage is equal to a target ozone concentration value; and the control panel determining, for each wash stage, a current stage contact time value, and the control panel adding each of the current stage contact time values with one another to obtain a cumulative contact time value, and the control panel controlling the washing machine so that the cumulative contact time value of the ozone with the laundry, for the entire wash cycle, is at least 70% of a duration of time of the entire wash cycle from the initial wash stage to the final wash stage; and if the cumulative contact time value of the ozone with the laundry is less than 60% of the duration of time of the entire wash cycle, then the control panel indicates that the laundry is not sanitized and the laundry must be rewashed.

10. The system for controlling a concentration of ozone according to claim 9, wherein the ozone sensor senses an amount of ozone contained in air either contained in or exhausting from the washing machine and, in an event that the concentration of the ozone in the air either contained in or exhausting from the washing machine exceeds the target ozone concentration value, the control panel discontinues the supply of ozone to the washing machine until the ozone sensor again senses that a current concentration of the ozone in the air either contained in or exhausting from the washing machine is at or below the target ozone concentration valve.

11. The system for controlling a concentration of ozone according to claim 9, wherein the system further comprises an area ozone level sensor which detects a level of ozone contained within an area accommodating the washing machine, and, in an event that the area ozone level sensor detects an excess level of ozone contained in the area, the control panel discontinues the production of ozone until the area ozone level sensor again senses that the concentration of the ozone in the area accommodating the washing machine is below a safe level of ozone.

12. The system for controlling a concentration of ozone according to claim 9, wherein the duration of time of the entire wash cycle is between 25 and 40 minutes, and the cumulative contact time value is at least 15 parts per million multiplied by minutes.

13. The system for controlling a concentration of ozone according to claim 9, wherein the system only supplies ozonated water to the washing machine each time the washing machine is filled during the initial wash stage and each subsequent wash stage; and a venturi facilitates initial mixing of the ozone with the filling water to form the ozonated water, and the ozonated water is then supplied to a static mixer where the ozone is further intimately mixed and encapsulated within the filling water prior to the ozonated water being supplied into the washing machine.

14. The system for controlling a concentration of ozone according to claim 13, wherein the ozonated water, once the ozonated water exits from the static mixer, is provided with a dwell time of between about 2 seconds to about 4 seconds, to increase further intimate mixing and encapsulation of the ozone within the filling water, prior to the ozonated water being discharged into the washing machine.

15. The system for controlling a concentration of ozone according to claim 1, wherein:

the control panel controls the supply of the ozone to the washing machine; and the supply of ozone to the wash machine is controlled so that a monitored current concentration of ozone within the washing machine is within a band of between 70% and 100% of the target ozone concentration value and the cumulative contact time value of the ozone with the laundry approaches 100% of the duration of time of the entire wash cycle.

16. The system for controlling a concentration of ozone according to claim 9, wherein the cumulative contact time value of the ozone with the laundry being washed is at least 21 parts per million multiplied by minutes to ensure killing of any infectious diseases contained within the laundry.

17. The system for controlling a concentration of ozone according to claim 9, wherein the cumulative contact time value of the ozone with laundry being washed is at least 24.5 parts per million multiplied by minutes to ensure killing of any infectious diseases contained within the laundry.

18. A system for controlling a concentration of ozone in contact with laundry being washed thereby ensuring killing of any infectious diseases contained within the laundry, the system comprising:

an ozone supply being connected to a water source, the water source supplying unozonated water to the system and the ozone supply introducing ozone into the unozonated water so as to produce ozonated water;

a washing machine having an internal drum enclosed within an external housing for containing the laundry and a quantity of the ozonated water;

an ozone generator for supplying additional ozone to the washing machine during each wash stage of an entire wash cycle, the ozone supply being arranged upstream from the washing machine, between the water source and the washing machine, and the entire wash cycle comprises an initial wash stage, at least one subsequent wash stage and a final wash stage;

an ozone sensor directly communicating with the internal drum for directly sensing at least a current ozone level within the internal drum during each wash stages;

a visual display communicating with the ozone sensor for instantaneously displaying, during the each wash stage, at least one of:

a wash stage contact time value for a current one of the initial wash stage and the at least one subsequent wash stage, and a running cumulative contact time value for the entire wash cycle; and a control panel being coupled to the ozone sensor, the visual display and the ozone generator, the control panel facilitating modification of production of the ozone by the ozone generator such that the control panel controlling the supply of ozone to the washing machine so that a final cumulative contact time value of the ozone with the laundry during the entire wash cycle is at least 21 parts per million multiplied by minutes; and if the cumulative contact time value of the ozone with the laundry is less than 60% of the duration of time of the entire wash cycle, then the control panel indicates that the laundry is not sanitized and the laundry must be rewashed.

* * * * *